US011028650B2

(12) United States Patent
Casad et al.

(10) Patent No.: US 11,028,650 B2
(45) Date of Patent: Jun. 8, 2021

(54) DOWNHOLE TOOLS WITH IMPROVED ARRANGEMENTS OF CUTTERS

(71) Applicant: Ulterra Drilling Technologies, L.P., Fort Worth, TX (US)

(72) Inventors: Christopher M. Casad, Benbrook, TX (US); Carl Aron Deen, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 16/104,855

(22) Filed: Aug. 17, 2018

(65) Prior Publication Data

US 2020/0056430 A1 Feb. 20, 2020

Related U.S. Application Data

(60) Provisional application No. 62/719,109, filed on Aug. 16, 2018.

(51) Int. Cl.
*E21B 10/43* (2006.01)
*E21B 10/55* (2006.01)
*E21B 10/60* (2006.01)

(52) U.S. Cl.
CPC ..... *E21B 10/43* (2013.01); *E21B 10/55* (2013.01); *E21B 10/602* (2013.01)

(58) Field of Classification Search
CPC ..... E21B 10/43; E21B 10/55; E21B 10/602; E21B 2010/425
See application file for complete search history.

(56) References Cited

U.S. PATENT DOCUMENTS

| | | | | |
|---|---|---|---|---|
| 4,794,994 | A * | 1/1989 | Deane | E21B 10/43 175/393 |
| 6,062,325 | A * | 5/2000 | Taylor | E21B 10/42 175/378 |
| 6,834,733 | B1 * | 12/2004 | Maouche | E21B 10/55 175/378 |
| 8,517,124 | B2 * | 8/2013 | Hareland | E21B 10/62 175/393 |
| 2015/0368979 | A1 * | 12/2015 | Casad | E21B 10/42 175/57 |
| 2017/0211336 | A1 | 7/2017 | Simmons et al. | |
| 2020/0011137 | A1 * | 1/2020 | Maurstad | E21B 10/43 |

OTHER PUBLICATIONS

Ulterra, "The Cutting Conundrum: SplitBlade Enhances Cuttings Evacuation and Improves Efficiency", Discovery Call, Available online at https://ulterra.com/pdc-bit/the-cuttings-conundrum/, accessed from internet on Aug. 21, 2019, 11 pages.
International Application No. PCT/US2019/046673, "International Search Report and Written Opinion", dated Nov. 12, 2019, 11 pages.
International Application No. PCT/US2019/046673, International Preliminary Report on Patentability, dated Feb. 25, 2021, 8 pages.

* cited by examiner

*Primary Examiner* — Matthew R Buck
(74) *Attorney, Agent, or Firm* — Kilpatrick Townsend & Stockton LLP

(57) ABSTRACT

Earth boring tools having offset blades with a plurality of fixed cutters having side rake or lateral rakes configured for improving chip removal and evacuation, drilling efficiency, and/or depth of cut management as compared with conventional arrangements.

20 Claims, 12 Drawing Sheets

DOWNHOLE TOOLS WITH IMPROVED ARRANGEMENTS OF CUTTERS

FIELD OF INVENTION

The invention pertains generally to drill bits, reamers, and similar downhole tools for boring earth formations using fixed cutters mounted on a rotating body.

BACKGROUND

Rotary drag bits, reamers, and similar downhole tools for boring or forming holes in subterranean rock formation when drilling oil and natural gas wells are attached to a drill string and rotated to drag discrete, fixed cutting structures mounted on the body of the tool against the formation. These cutting structures or elements are called "cutters." Rotating the tool causes the cutters to fail the rock through a shearing action. The resulting rock chips or shavings—referred to as cuttings—are flushed from the face of the tool and carried to the surface using a circulating medium that is pumped down the drill string and out nozzles in the face of the tool. The drilling fluid carrying the cuttings flows to the surface in the annulus between the wall of the wellbore and the drill string. The circulation medium can be drilling fluid (also called drilling "mud") or a gas or foam ("air").

A "PDC bit" is one example of a rotary drag bit comprised of a body on which is mounted discrete PDC cutters in fixed positions. PDC cutters have work or wear surfaces comprised of sintered polycrystalline diamond (PCD) or other highly abrasion-resistant material. "PDC cutter" usually refers to a discrete cutting element comprised of a compact with one or more wear layers made from sintered polycrystalline diamond (either natural or synthetic) exhibiting diamond to diamond bonding attached to a metal carbide substrate, typically tungsten carbide. The compact may also, for example, include transitional layers in which the metal carbide and diamond are mixed with other elements for improving bonding and reducing stress between the PCD and substrate. But the term is also sometimes used generically to refer more generally to cutters with diamond-like wear surfaces. Polycrystalline cubic boron nitride, wurtzite boron nitride, aggregated diamond nanotubes (AND) or other hard, crystalline materials can be substituted for polycrystalline diamond at least in some drilling applications. Sintered compacts of polycrystalline cubic boron nitride, wurtzite boron nitride, ADN and similar materials are, for the purposes of this disclosure, equivalents to polycrystalline diamond compacts. Rotary drag bits with cutters that have super-hard wear surfaces like diamond are sometimes generically referred to as PDC bits even if the super-hard wear layer is not made of diamond. Therefore, references to "PDC bits" in the following written description should be construed as including bits with cutters having wear resistant surfaces made of polycrystalline diamond and suitable substitutes, as well as compacts with wear resistant layers containing other materials or structure elements that might be used to improve the properties and cutting characteristics of the wear resistant layers. Furthermore, to avoid any doubt, references to polycrystalline diamond are intended to encompass thermally stable varieties of sintered polycrystalline materials, in which a metal catalyst has been partially or entirely removed after sintering.

Drag bits and other downhole tools with fixed cutters typically have no moving cutters or other parts. The bodies of drag bits, such as PDC bits, are often cast or milled as a single piece body. A body of a PDC bit can be made of steel or steel alloy (a steel bodied bit), a matrix material (a matrix bit), or another type of material. Matrix bodies are typically comprised of tungsten carbide and a binder phase comprised of metal, such a cobalt and alloys of cobalt. A hard-facing material may also be applied to areas of the bit body to improve abrasion resistance. PDC bit bodies typically range in diameter from around 4 inches to more than 26 inches.

The body of a rotary drag bit, and in particular a PDC bit, has a a cutting face that is generally oriented toward the formation in the direction in which the wellbore is being advanced and a gage that establishes the outer diamond of the bit, and a standard API connection for connecting it with the drill string or rotating shaft. The shape or geometry of a PDC bit face and gage is defined in part by two structural features: "blades" and "junk slots." Primary cutters are arranged in rows on the face of the bit to allow for channels to be defined in the bit body in front of the primary cutters. These channels that provide room between the drill bit and the formation for the cuttings to be evacuated efficiently by the circulation medium and are referred to as "junk slots." Cuttings, if not evacuated from the cutting face of a drag bit, will clog the action of the bit and the cutters, which will decrease drilling efficiency. In the case of certain types of rock or soil, such a clay, the cuttings may be sticky and tend to gum up and adhere to the cutters and the bit, interfering with the bits rotation and cutting action. Cuttings are removed by directing hydraulic drilling fluid or air at high pressures and velocity down across the faces of the cutters and down the junk slot. The drilling fluid is directed using nozzles located in the junk slots.

The raised structural features on the cutting face and gauge between the channels, on which the cutters are mounted, are referred to as "blades. The blades and junk slots along the bit's face generally in a radial direction toward and then down the gauge of the body. The cutters are mounted on the blades in fixed positions, with fixed orientations, usually by brazing them into pockets that have been formed in the blades during casting or machining of the body. Each blade supports a plurality of discrete cutters. PDC bits may have any number of blades. PDC bits with 3-6 blades are typical, though more than 6 is possible. Some blades extend outwardly from the center of the bit to the gauge. These are referred to as primary blades. Other blades, referred to secondary blades, do not extend to the center of the bit. Most PDC bits share a similar cross-sectional shape, or profile. The center has a cone-like shape, which is usually concave though there are examples of PDC bits with convex cones. The diameter, depth and angle of the cone is chosen by a variety of design considerations and performance tradeoffs. Surrounding the cone is an area referred to as the nose. The area or region radially outward of the cone is referred to as the shoulder, where the bit's profile transitions from the nose to the gauge. Cutters on the shoulders of PDC bits function primarily to enlarge the borehole initiated by cutters located on the nose and in the cone.

In addition to a radial position within a cutting profile, each cutter has a size and an orientation. Generally, orientation is defined with respect to one of two coordinate frames: a coordinate frame of the bit, defined in reference to the bit's axis of rotation; or a coordinate frame generally based on the cutter itself. The orientation of a cutter is usually specified in terms of a rotation about two axes: a side inclination or rotation and a forward/back inclination or rotation of the cutter. Side inclination is typically specified in terms of a lateral rake angle or side rake angle, depending on the frame of reference used. For the sake of simplicity, a reference to side rake or side rake angle is intended to include and encompass lateral rake, and vice versa, unless otherwise specified. Back inclination is specified in terms of an axial rake or back rake angle, depending on the frame of reference used. The cutter geometry for a bit can thus be specified by each cutter's radial position and distance from the center line of the bit, its angular position of the cutter on the bit face, the blade on which it is mounted, and its orientation.

FIG. 1A represents a schematic illustration of part of a cutting structure geometry for a PDC bit that is comprised of discrete, fixed cutters mounted on a plurality of blades (not shown.) The figure is intended to illustrate the concept of side rake. The gauge of the bit is generally indicated by circle 110. Only three fixed cutters, 112, 114, and 116 are illustrated for sake of clarity. A typical PDC bit will have many more than three cutters. Reference number 118 identifies the center or axis of rotation of the bit in FIG. 1. Radial line 120 represents zero degrees angular rotation around central axis (axis of rotation) 118, which is the bit's axis of rotation. Fixed cutters 112 and 114 are located in this example on the same radial line 122, at the same angular rotation, as indicated by angle 124, but they are radially displaced distances 126 and 128, respectively. In this example, they are located on the same blade, which is not indicated on the schematic representation. Cutters on the same blade do not, however, always lie along a straight line that intersects with the center axis of the bit. Blades are often curved so that the angular position of a cutter on the blade is rotationally displaced with respect to the preceding cutter as the blade extends toward the gauge. A curvilinear line can typically be drawing through the faces of the cutters mounted on the leading edge of a curved blade. The curve of the line connecting the cutter faces corresponds generally to curve of the leading edge of the blade. Cutter 116 lies on the radial line 132, which has a substantially larger angular position, as indicated by angle 133. Its radial displacement from the axis of rotation is indicated by distances 134, which is greater than the distances of the other two cutters 112 and 114.

Each of the cutters 112, 114, and 116 are shown having different amounts of side rake, which are indicated by angles 136, 138, and 140, respectively. Side rake is defined, in this example, by the angle between (1) a line that is perpendicular to the radial line for that cutter through a point defined by the intersection of the cutting surface of the cutter and the main axis of the cutter and (2) the main axis of the cutter. In the case of cutter 114, for example, the side rake angle 138 is defined between line 135, which is perpendicular to the radial line and main axis 139 of the cutter. To simplify the illustration none of the cutters are shown having any back rake. The definition above is true for cutters having back rake.

The center or main axis of the cutter or a line parallel to it is customarily used by designers as a centerline for the cutter to specify the orientation of the cutter in terms of side and back rake. A typical fixed cutter for a rotary drag bit, such as a PDC cutter, will have a cutting face comprised of one or more working surfaces for engaging the formation and performing the work of fracturing the formation. These surfaces will tend to experience the greatest reactive force from the formation. Traditional PDC cutters are cylindrical in shape. The cylindrical shape of the substrate is a function of fabrication processes. It also allows the cutter to be rotated when placed in the pocket. The super-hard, abrasion resistant material comprising the cutting face has disk-like shape—it is sometimes called a "table"—with a relatively flat cutting face. Thus, the axis of the cutter is usually normal to the cutting face of the cutter.

However, the substrate and table could be sintered into different shapes and/or be ground or machined to form different shapes. For example, the substrate could be an oblique cylinder rather than right cylinder, and/or formed with non-circular to have a cross-sectional shape. The cutter might have one or more planar side surfaces or have a polygonal (3 or more sides) cross-sectional shape. The transition between the side wall and the top surface of the table can be beveled, chamfered or curved, for example, around the entire circumference of the cutter. Additionally, the cutting face may be shaped to have one or more planar working surfaces that are not normal to the substrate's central axis, to have one or more curved surfaces (for example, a dome shape), to have one or more non-planar working surfaces, or to have combinations of two or more of these types of surfaces. Furthermore, the one or more layers of abrasion resistant material need not be made with a uniform thickness. The substrate and the one or more layers of abrasion resistant material applied to the substrate may form any number of shapes, such as ridges or cones. Nevertheless, the convention of using the central axis of the cutter to specify orientation for these types of cutters can still be used. However, for cutters with angled cutting faces or working surfaces, a vector normal to the cutting face, or to the predominate orientation of the face or working surfaces could be used instead to specify the axis of the cutter for determining side rake and back rack of cutters.

Positive side rake angles will tend to push the pieces of the formation sheared or broken away by the cutter (cuttings) toward the periphery of the bit, away from the axis of rotation or center of the bit. Negative side rake will tend to push the cuttings inwardly toward the axis of rotation and thus into the flow of drilling fluid that is exiting the nozzles in junk slots or channels that are formed on the face of the bit in front of each blade. Placing next to a cutter that has a more outward side rake with a cutter that has a more inward side rake may facilitate breaking apart cuttings.

Curve 142 of FIG. 1B represents a cutting profile of the bit of FIG. 1A, with the outer diameters of the cutting faces of the individual cutters 112, 114, and 116 represented by circular cutter face outlines 144, 146, and 148, respectively. The profiles of the cutters are formed by rotating their respective positions to the zero degree angular rotation radial line 120 (FIG. 1A) and projecting them into a plane in which the axis of rotation 118 and the zero degree angular rotation radial line 120 lie. Bit cutting profile curve 142 touches each cutter at one point. A cutting profile generally indicates an intended cross sectional shape in the borehole formed by bit as it is penetrating the formation. However, when weight is placed on a bit to cause it to penetrate the formation and advance a hole, the actual paths of the cutters will tend to be helical as the rotate about the center axis of the bit. Note that each of the cutter face outline 144, 146, and 148, assume for the purposes of simplifying the illustration that the cutters do not have any back rake or side rake. If a cutter had any bake rake or side rake, the projection of the outside diameter of the PCD layer into a plane through the radial line for that cutter would be elliptical.

As a bit is rotated, the cutters on the bit collectively present one or more cutting profiles to the rock formation, shearing the formation. A cutting profile is defined by rotating the cutters rotate through a plane extending from the bit's axis of rotation outwardly. A line tangent to each of the profiles the individual cutters is the bit's cutting profile. A cutter's radial position in a cutting profile is the distance of a line normal to the axis of rotation and extending from the axis of rotation to a point at which a cutter's profile is tangent to the bit's cutting. It is not determined by cutter's angular or rotational position on the face of the bit. Cutters on a bit are typically consecutively numbered, with the first cutter being the one closest to the center of the bit, and each consecutively numbered cutter being the next closest. The number will form a spiral pattern, with cutters are located at the same radial position being numbered consecutively in a manner consistent with the spiral pattern.

Rotary drag bits may have multiple cutting profiles, for example a primary cutting profile and one or more secondary cutting profiles. The primary cutting profile is comprised of the cutters that do most of the work of failing the formation. The primary cutters have the greatest exposure to the formation. The exposure of a cutter is usually a function of the distance that cutter extends above a blade on which it is mounted. Primary cutters will also be placed along the leading edge of each blade, adjacent to a junk slot so that they can benefit from the action of the circulation medium—drilling fluid in most cases—to clear cuttings and cool the cutters. Secondary profiles usually have lower exposures and are intended to do less work. Backup cutters, which are mounted on same blade directly behind a primary cutter in the same radial position, will have a lower exposure than a primary cutter and are thus on a secondary profile. Backup cutters engage the formation when the primary cutter fails or wears down to a point at which the backup cutter begins to engage the formation. Typically, there is one cutter per radial position on a cutting profile. However, bit designers may set two or more cutters with the same exposure in the same radial position on a cutting profile—for example, two primary cutters or two backup cutters. Backup cutters are generally set in the same radial position (the same radial distance) from the cutter that they backup, but they are on a different profile.

Referring now also to FIG. 1C, point 150 is a point at which the main axis of the cutter, which in this example is assumed to be the center axis of the cutter, intersects a planer portion of the cutting face. This point can be used as origin of a reference frame for defining side rake and bake rake of the cutter in the following description. Line 152 represents the side rake axis, which is the axis about which the cutter is rotated to establish side rake. The side rake axis is normal to the tangent to the cutter profile at the point where the projection of the cutter face diameter or outline 144 touches the bit cutting profile curve 142 and extend through point 150. Line 154, which crosses the cutter's main axis and is parallel to the axis of rotation 118, represents the side rake axis of the cutter. Angle 156 between side rake axis 152 and side rake axis 154 relates to the cutter profile angle. The angle of rotation (not indicated) of a cutter about the side rake axis 152 is its side rake angle. Line 158 represents the cutter's back rake axis. Rotation of the cutter around this axis defines the back rake angle of the cutter. The back rake axis is orthogonal to the cutter's main axis and the side rake axis 152.

Line 160 represents the zero angle for the cutting profile and for specifying a cutter's angular position. Section 162 of the cutting profile corresponds to the cone of an example of a PDC bit. The profile angles in this section are somewhere between 270 degrees and 360 (or zero) degrees. The profile angles increase toward 360 degrees starting from the axis of rotation 118 and moving toward the zero degree profile angle at line 160. The bit's nose corresponds generally to section 163 of the cutting profile, in which the profile angles are close to zero degrees. Portion 164 of the profile corresponds to the bit's shoulder section. The profile angles increase quickly in this section until they reach 190 degrees. Within section 166 of the cutting profile, corresponding to the gauge section of the bit, the cutting profile is approximately at 90 degrees.

A cutter mounted with a large side rake is, in effect, angled to the formation as it is rotated. Cutters without large side rakes tend to bluntly plow through the formation. Cutters oriented to have a larger side rake will tend cut they more efficiently and slice through rock, reducing reactive torque on the drill bit. This can lead to better stability and control of the face of the bit. Cutters with negative side rakes can also enhance evaluation of cuttings by forcing cuttings into the hydraulic flow path to enhance evacuation. A cutter set with a side rake will tend to generate a lateral force on the bit. Furthermore, side rakes of two or more cutters on a blade or in a cutting profile can be set in a manner that tends to reduce bit vibration and increase cutting efficiency by transferring lateral forces acting one cutter back into the formation through another cutter or group of cutters on the bit that have a significantly different side rake.

SUMMARY

The claimed subject matter relates to one or more aspects of improved downhole tools with fixed cutters for forming wellbores in rock. The improvements allow for more side rake and, in some cases, placement, of fixed, discrete cutters on blades. The various aspects of the improvements are described below in connection with representative examples of rotary drag bits embodying one or more aspects of the improvements. The following is a brief summary of the disclosure and is not intended to imply any limitations on the scope of claimed subject matter.

Minimal spacing requirements for mounting primary cutters along the leading edges of blades limit both the amount that a primary cutter can be rotated to increase side rake, as well as the size of the difference in side rake angles that two cutters on the blade, particularly two adjacent cutters, can have. The minimum spacing requirements are necessary to ensure that cutters are mounted in recesses within the blade in a manner that weakens the structural integrity of the mounting and the blade. The minimum spacing requirements thus limit the degree to which side rakes can be used to create counteracting lateral forces, at least without reducing the number of cutter or increasing the radial spacing of the cutters on the cutting profile, both of which may be undesirable.

Furthermore, orienting primary cutters mounted in a cone region of rotary drag bit to have side rakes that generate counteracting lateral forces tends to be more effective at dampening bit vibration and increasing cutting efficiency than similar orientations of cutters elsewhere on the bit. Primary cutters mounted in a cone region of PDC are used to advance the wellbore and typically penetrate and engage the formation prior to cutters in the nose and shoulder regions of a PDC bit. However, the cone area of a rotary drag bit tends to be relatively small and crowded. Increasing spacing between cutters to accommodate larger side rake angles is undesirable, thus limiting the degree to side rakes for generating the desirable effects counteracting lateral forces where it might otherwise be most effectively applied.

In one representative embodiment, a rotary drag bit comprises a plurality elongated blades on which are mounted discrete cutters in fixed positions and with fixed orientations. At least one of the blades has two or more portions that are rotationally offset from each other. The offset gives more room on the blade for rotating one or more primary cutters mounted on a leading edge of the blade to a larger side rake angle or set several the primary cutters so that create a larger difference in side rake angles between cutters on the blade without having to reduce the number of cutters on the blade or change cutter dimensions. The offset also allows for adjacent cutters on the blade to be rotated to have larger differences in side rake angles. Larger side rakes will tend to create reactive forces on the bit that have a larger lateral component, resulting in a larger lateral force on the bit. Larger lateral forces on the bit, when counteracted, tend to further improve dampening of bit vibration and/or cutting efficiency. This feature can be particularly advantageous for primary cutters in the cone region of the rotary drag bit but is not limited to that area.

In other embodiment, a rotary drag bit comprises a plurality elongated blades on which are mounted discrete cutters in fixed positions and with fixed orientations. At least one of the blades has two or more portions that are rotationally offset from each other. The offset blade allows the radial distance between a pair of adjacent primary cutters on an offset blade with side rakes oriented to generate counteracting lateral forces to be made shorter as compared to a pair of adjacent cutters on a conventional blade. One primary cutter in the pair is the last primary cutter position on an inner blade portion of an offset blade, and the second primary cutter in the pair is the first primary cutter on the second blade portion. A shorter radial distance between cutters on the same blade will tend to improve the counterbalancing of the lateral forces generated by the side rakes on each of the cutters. Generally speaking, the desirable effects from generating lateral forces with side rakes can be increased the closer that a counterbalancing cutter is to a cutter that creates a lateral force. The counteracting lateral forces on the bit caused by the side rakes can be better balanced. Minimum spacing requirements limit reducing radial spacing of adjacent cutters on the blade. Reducing radial spacing between cutters can be achieved by cutters on different blades, though angular separation is increased. However, too much cutter density within a bit profile because of overlapping cutters tends to slow rate of penetration. Considerations of cutter density on the bit profile may constrain locating cutters to improve the effects of the counteracting lateral forces from cutters from a given difference in side rake angles. An offset blade allows for closer radial spacing on the same blade between a pair of cutters that are being counterbalanced without having them overlap in the cutting profile or substantially increase cutter density. Furthermore, the amount of the side rake, and thus also the difference in side rake angles, for the cutters in the pair can be increased, which will also tend to increase the effects of dampening of bit vibration and/or cutting efficiency from counterbalanced lateral forces.

In yet another representative embodiment, a PDC bit comprises a plurality of blades, at least one of which is a primary blade that comprises at least two portions, one inner and one outer, that are radially and rotationally offset with respect to each other. The inner blade portion and the outer blade portion each have a plurality of primary cutters mounting along their leading edges, with the inner most primary cutter on the outer blade portion at least partially overlapping with the outmost primary cutter on the inner blade portion. A partial overlap allows for greater spacing of cutters on each blade portion without having to reduce the number of cutters and also allows for two adjacent cutters in same position on the primary cutting profile of the bit to be on the same blade, to have a relatively large difference in side rake, and to further reduce the distance between cutters on the same blade to improve the effects of dampening of bit vibration and/or cutting efficiency from counteracting lateral forces on the bit caused by the differences in side rake angles of the cutters.

Non-limiting, representative examples of downhole tools that embody these and other features, as well as their respective advantages, are described more fully below.

DETAILED DESCRIPTION OF EXEMPLARY EMBODIMENTS

In the following description, like numbers refer to like elements.

Figure 1A:
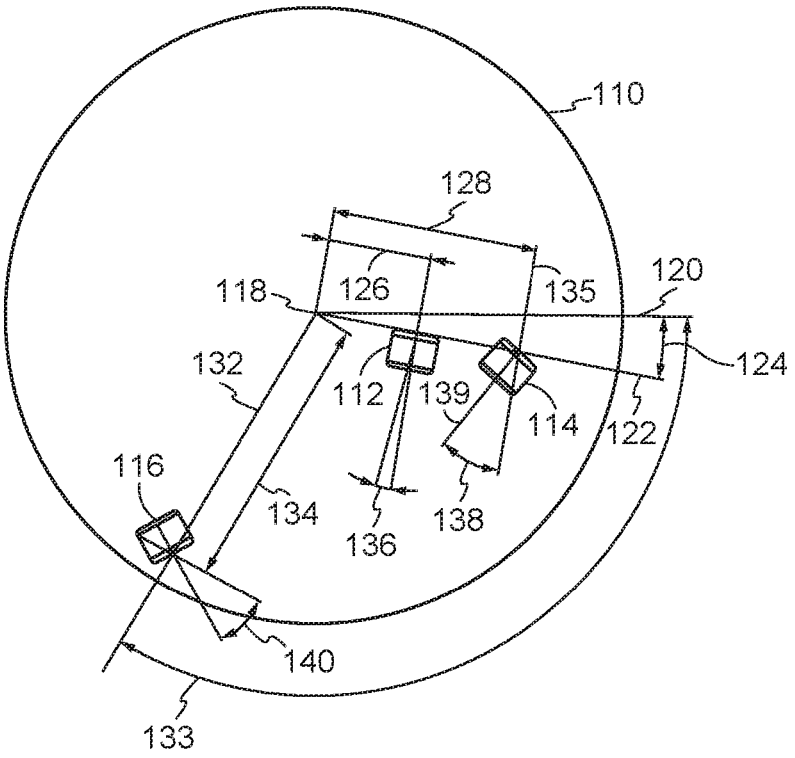
FIG. 1A Prior Art
FIG. 1A represents a schematic illustration of a face view of a rotary drag bit.
Figure 1B:
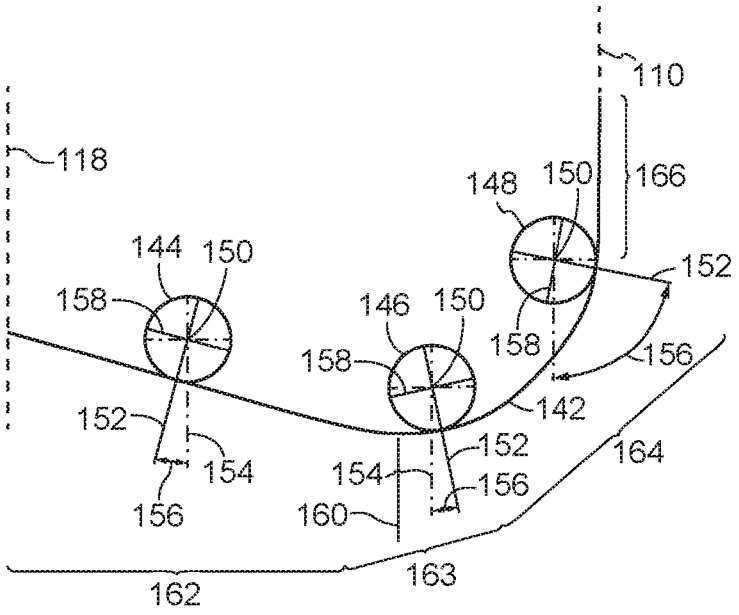
FIG. 1B Prior Art
FIG. 1B represents a schematic illustration of a cutting profile for a PDC bit.
Figure 1C:
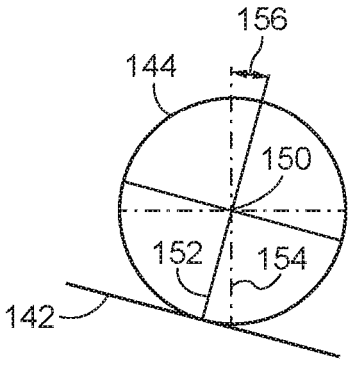
FIG. 1C Prior Art
FIG. 1C represents a schematic illustration of one of the cutters from FIG. 1B.
Figure 2A:
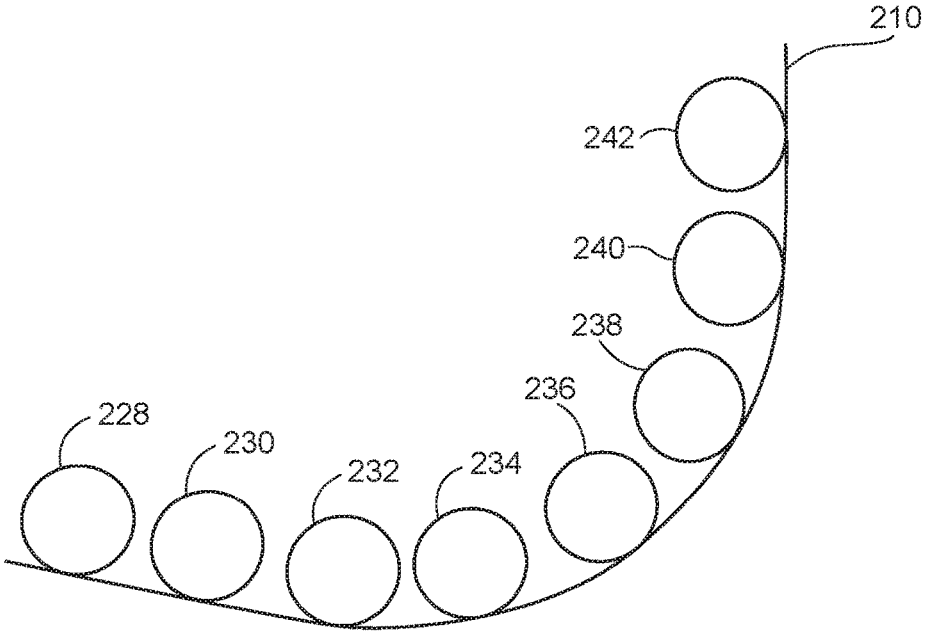
FIG. 2A Prior Art
FIG. 2A represents a cutting profile of cutters on a blade for typical PDC bit.
Figure 2B:
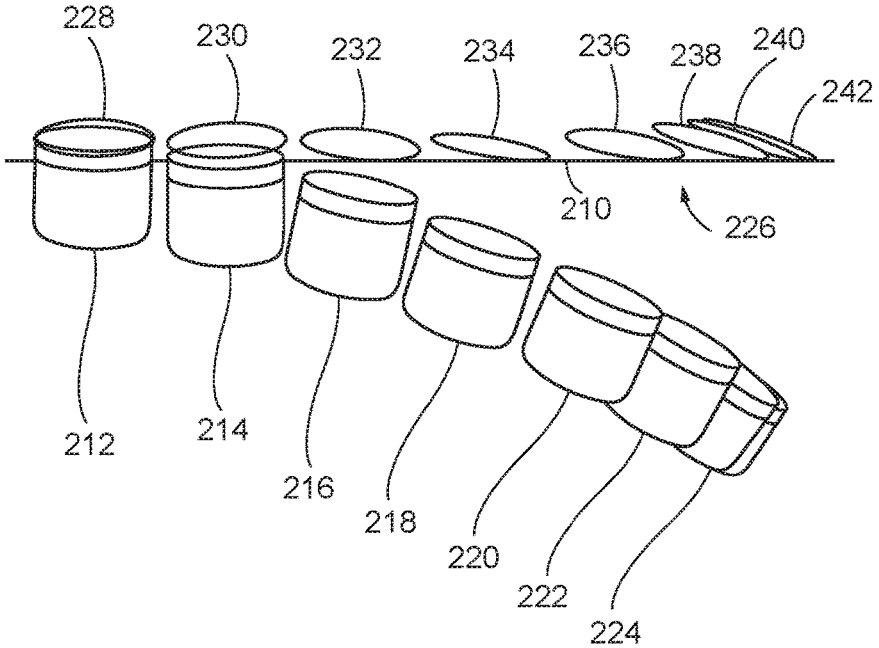
FIG. 2B Prior Art
FIG. 2B represents a two-dimensional rendering of the three dimensional geometry of the cutters shown in the cutting profile of FIG. 2A.

Referring now to FIGS. 2A and 2B, primary cutters on a particular blade of a bit will be mounted on the bit's primary cutting profile. FIGS. 2A and 2B depict a representative example of a cutter geometry for a conventional of a PDC bit and the cutter profile of the cutters on the blade relative to the bit's primary cutting profile. A plurality (eight in this example) of fixed primary cutters 212-224 (plus one additional that cannot be seen in FIG. 2B) are rendered in the positions and orientations in which they would be mounted on a blade (not shown) of a PDC bit (also not shown.) The positions of the cutters in a three-dimensional coordinate frame and their orientation comprise a cutter geometry. This figure thus represents the cutter geometry for a blade. In this representative example, cutters 212 and 214 are in the nose region; cutters 216 and 218 are in the nose region or area of the bit; and cutters 236, 238, 240, and 242 are in the shoulder area or region.

The bit's primary cutting profile is indicated by line 210. The primary cutting profile for a bit and for a blade is defined by the primary cutters when they are rotated around the bit's axis of rotation through an imaginary plane coincident with the axis of rotation. The individual cutter's profiles 228-242 are circular or oval in shape and indicate the radial positions of the cutters and the periphery (shape and size) of the cutting face each cutter as it passes through the plane.

In the figures, the individual cutting profile of each cutter is a projection and will not indicate contours of the surface or surfaces that comprise the cutting face. A cutting face may comprise multiple surfaces. Furthermore, the entire cutting face will not, typically, be used to fail the formation, though much or most of it may contact cuttings as they curl away from the formation. The size and shape of the working surfaces will be determined by a number of factors, including the type of formation, the amount of weight on the bit, the exposure of the cutters (height of the cutter extending above the blade), and features on the blade or elsewhere on the bit that limit depth of cut.

Line 210, which is tangent to circles 228-242 that represent the cutting profile of the individual cutters, represents the cutting profile of the blade and aligns with and corresponds to the cutting profile for the bit. All primary cutters on a bit are mounted so that they are on the same profile, the primary cutting profile. The individual cutting profiles of each of the other cutters on other blades of the bit that are in the same cutting profile will be tangent to this line as they rotate through the imaginary plane.

Only seven of the eight cutters can be seen in FIG. 2B, as cutter 224 is occluded from this perspective, the eighth cutter that corresponds with cutter profile 242. FIG. 2B includes a rendering of the profile of FIG. 2A as it would appear from the perspective from which that rendering is created. The cutters oriented with non-zero side rake angles will tend to have the cutting profile that is narrower (more elliptical) in a blade or bit cutting profile and the cutting profiles for the cutters that is shown in the three-dimensional cutter geometry view of FIG. 2B will appear to be rotated with respect to the plane of the cutting profile. Any backup cutters on the blade (not shown) would or may be on a different cutting profile.

Figure 3:
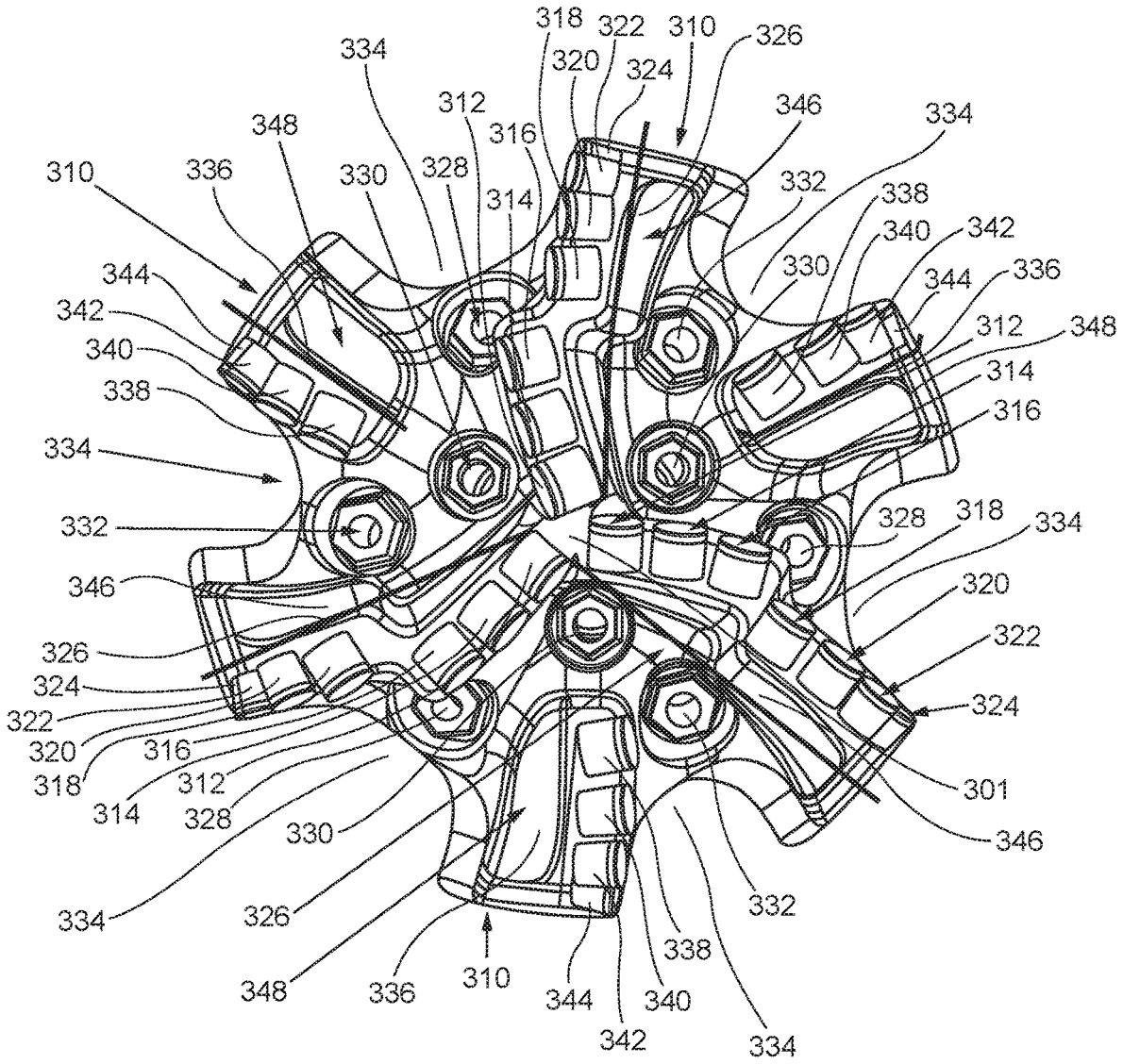
FIG. 3 is a face view of an example of a PDC bit that is representative of a rotary drag bit with fixed cutters and, more generally, a downhole tool for cutting rock with fixed cutters arranged on blades.

FIG. 3 represents a view of the face a PDC bit 310, which is a non-limiting, representative example of a rotary drag bit. PDC bit 310 has a plurality of cutters (PDC or other types) mounted on a plurality of blades. This particular embodiment has six blades, three of which are primary blades. The other three are secondary blades. The primary blades extend from near the center of the axis of rotation 301, through the cone, nose and shoulder regions, to the gauge of the bit. In this example, each are an offset blade 326. The secondary blades 336 extend from the nose region of the bit, through the shoulder region, and then to the gauge of the bit. They are not offset. In alternative embodiments, one or more of the blades are offset blades. The various features or aspects of the improvements disclosed herein are not limited to a bit with a particular size or number of cutters or blades unless otherwise specifically stated.

The leading edge of a traditional blade, where front wall of the blade transitions to the top surface of the blade and along which the primary cutters are mounted, is curvilinear. However, each offset blade has a leading edge with a pronounced step or set back where it transitions from a first blade portion to a second blade portion. The distal end of the first leading edge portion is rotationally or angularly offset from the proximal end of the second leading edge portions, forming a step or offset such that the difference between the angular position of last cutter (most radially distant) on the first blade portion and the angular position of the first cutter on the second blade portion is much greater than the differences in angular positions of the last two cutters on the first blade section and the difference in the angular positions of the first two cutters on the second blade portion. In the illustrated embodiment, an offset blade is continuous, without a gap in the wall of the blade where the offset occurs. However, in alternative embodiments, a small gap between the blade portions may be formed.

Each offset blade has seven cutters 312-324, which are primary cutters. They are mounted along a leading edge of the offset blade, adjacent to one of the channels or "junk slots" 334 that extends along the length of the offset blade. The offset blades 326 may also have cutters in the gauge area of bit 310, which are not visible in this view of this embodiment. Each offset blade 326 in this example is one continuous blade that has an offset in the blade geometry along the face or front wall of the blade. The offset is, in this embodiment, between cutter 316 and cutter 318. The offset creates two blade portions, a first (or inner) blade portion closer to the centerline or axis of rotation 401 of the bit that extends through the cone region of the bit to the offset, and a second (or outer) blade portion that extends from the offset, through the nose and shoulder regions, to the gauge of the bit. A proximal end of the second blade portion is displaced radially (outwardly from the axis of rotation) and angularly from a distal end of the first blade portion. In this example, the offset in offset blade 326 occurs approximately where the cone region of the bit transitions to the nose region of the bit. However, in other embodiments, for example, the offset may occur in or near other regions of the bit, such in the nose or shoulder, or at the transition of the nose to the shoulder. Furthermore, alternative embodiments of bits may have one or more, or all, of its offset blades with more than one offset and different numbers of offsets. For example, an offset blade could have three portions: a first, a second and third, with a first offset between the first two portions and a second offset between the second and third portions. Furthermore, one or more of the offset blades on a bit could have one offset; and one or more of the other offset blades could have two offsets. One or more additional offset blades on the bit could have three or more offsets.

The secondary blades 336 are used to increase the cutter density of the bit in the nose and shoulder of a bit. Cutters in these regions typically perform much of the work forming a wellbore. As the bit progresses downhole, more material must be removed from the borehole in these regions relative to the cone region because the wider radius of these regions, relative to the cone region, results in a greater surface area of rock that must be removed. The secondary blades allow for balancing the amount of exposed cutter in a region to the area of rock that must be removed from that region. Each of the secondary blades has four primary cutters 338-344 that are visible in this view and may have cutters in the gauge region of the bit 310 that are occluded from view. Cutters 338-344 each have a fixed position on bit 310. The fixed position of a particular cutter being defined by the blade on which the cutter is mounted, the axial distance from the center of rotation of the bit, and the relative radial position of the cutter on the face of the bit. Each cutter also has a set orientation: a back rake and a side rake.

Bit 310 also has a plurality of nozzles 328-332 which are located in a plurality of channels or junk slots 334. The junk slots 334 are located in front of each of the blades and are defined by the front wall of the blade and a back wall of the blade it follows. Nozzles 328-332 direct drilling fluid being pumped through the drill string, which is not shown, toward the cutters to flush cuttings from the face of the bit. Junk slots 334 create room for collecting and evacuating cuttings, with the junk slots direction the flow of drilling fluid and cuttings radially outwardly and then up through the gauge region and into an annulus between the wellbore side wall and the drilling string (not shown.)

Nozzles 330 are in front of the first blade portion (inner portion) of offset blade 326. The drilling fluid flowing from each of the nozzles 330 is primarily intended to clear cuttings coming off of primary cutters mounted along a leading of the first blade portion of each offset blade 326, which in this example are cutters 312, 314, and 316. The drilling fluid flowing from each of the nozzles 330 is secondarily intended to provide cooling and manage the operating temperature of primary cutters mounted along a leading of the first blade portion of each offset blade 326, which in this example are cutters 312, 314, and 316. Nozzle 330 are therefore directed so that drilling fluid flows across the face of these cutters 312-315 and down the junk slot 334 that is between the front of the offset blade and the back side of the secondary blade 326 in front of it.

Nozzles 328 are each tucked into the corner formed in the front wall of the blade formed by the offset in the offset blade 326. Each directs drilling fluid along the second blade, portion of each of the offset blades, toward faces of cutters 318, 320, 322, and 324, which are primary cutters mounted along a leading edge of the second blade portion of the offset blade.

Nozzles 328 are rotationally offset rearwardly with respect to nozzle 330 and radially outwardly. Because each nozzle 328 is rotationally displaced with respect to nozzle 330, fluid flowing from nozzle 328 tends not to interfere with fluid flow from the nozzle 330 or interferes much less than it would if it were not rotationally displaced. The nozzle 330 is aimed so that the drilling fluid from the nozzle, after flowing across the face of cutters 312, 314, and 318 in the first section of offset blade 326, tends for flow with the cuttings produced by those cutters primarily through the area between the back of secondary blade 336 and nozzle 328. Fluid flowing from nozzle 328 primarily flows across the face of cutters 318, 320, 322, and 324 and then continues along the front wall or leading edge of the second blade portion of the offset blade 326 into the annular space of the borehole.

The offset blades 326 and the secondary blades 336 of bit 310 in FIG. 3 also features sloped surfaces 346 and 348, respectively, on the back of the blades, behind the cutters that are arranged along the leading edge of the blades. The cutting face of the body of the bit, in particular the top surfaces of the blade, act to limit the penetration of the cutters into the formation. The primary cutters extend above the top of the blades or other feature or aspect of the bit that limits how far the cutters can penetrate into rock, which is referred to as cutter exposure. Generally, higher exposures will allow the primary cutters to penetrate deeper into the formation, which can increase the rate that the bit penetrates the formation (the rate of penetration or ROP) to advance the bore hole. On the other hand, if the primary cutter exposure is too high, other problems may arise that might retard rate of penetration or lead to premature failure of cutters and eventual damage or destruction of the drill bit. Therefore, exposure is chosen to optimize ROP while maintaining an acceptable degree of reliability. At high ROP the back part of the top surface of the blades might contact the formation before the front part of the top surface contacts the formation, resulting in added friction and possibly also a shallower penetration than the bit is otherwise capable of. Sloped surfaces 346 and 348 remove some of the blade without substantially weakening it where the back of each blade might otherwise contact the formation during high ROP. Instead of a sloped surface, a step or series of steps could be substituted, but possibly at the cost of added fabrication difficulties and/or a weaker blade.

Figure 4:
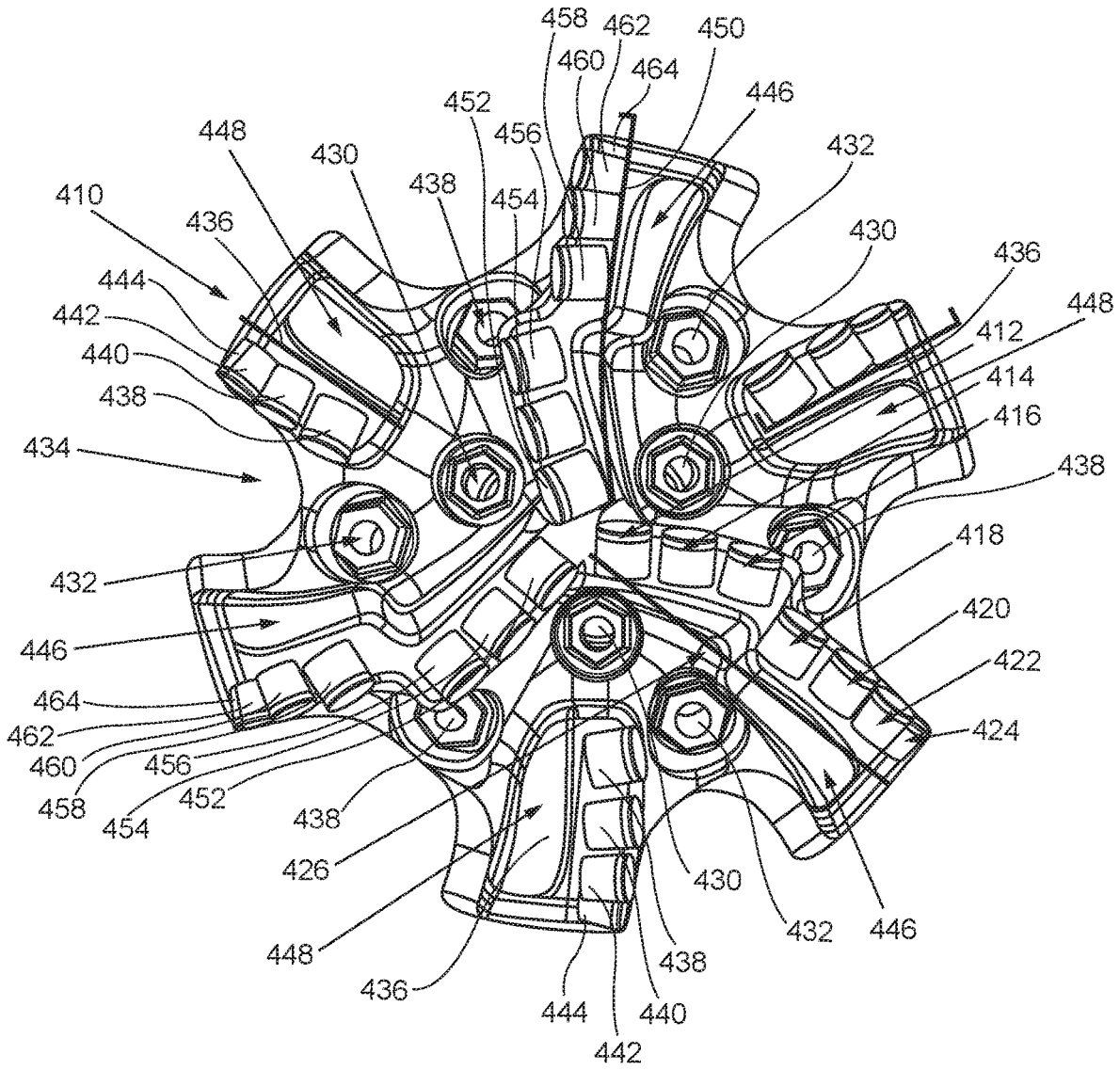
FIG. 4 is a face view of a second, representative example of a PDC bit.

FIG. 4 depicts another example of a PDC bit 410 similar to the example depicted in FIG. 3. It is intended to be representative of embodiments in the form of rotary drag bits generally, and more specifically PDC bits. It shares many similar features. The basic physical structure of bit 410 and bit 310 (FIG. 3) are similar. It has primary blades that are offset blades: an offset blade 426 with primary cutters 412-424; and offset blades 450, each with primary cutters 452, 454, 456, 458, 460, 462, and 464. Offset blades 450 each have a geometry with features similar to the features of the geometry of offset blades 326 shown in the embodiment of FIG. 3. (Note, however, that the cutter layouts and the orientations of the cutters are not the exactly the same.) Bit 410 has three secondary blades 436, each with cutters, cutters 452-464. These blades are not offset and have blade geometries and cutter layouts that are similar to the non-offset, secondary blades 336 in FIG. 3. Nozzles 428-432 are positioned within junk slots 434 in a manner that is similar to the positioning of nozzles 328, 330 and 332, respectively in the junk slots 334 in the embodiment of FIG. 3. They function in a similar manner. Nozzle 428, which is placed within the corner in the front wall of offset blade 426, is oriented so that drilling fluid reaches primary cutter 418. Sloping regions 446 and 448 are similar in terms of function and geometry to slope surfaces 346 and 348 of the bit in FIG. 3.

Though it shares many of the same features, offset blade 426 of bit 410 has a different offset blade geometry and cutter layout than the other offset blades 450. Briefly, the differences involve the last primary cutter of the first blade portion (the inner blade portion) of offset blade 426, which is primary cutter 416, partially overlaps the cutting profile of the first primary cutter of offset blade 426, which is primary cutter 418.

Referring now to FIGS. 3 and 4, the side rakes of the primary cutters along the leading edges of the offset and non-offset blades in each of these examples can be set to have relatively high side rake. Rotating a cutter angles its cutting face to the formation. When angled to the formation the cutter will tend to generate a reactive lateral force on the bit as the cutter when the cutter engages the formation. Selectively orienting two or more cutters on the bit to generate counteracting lateral forces on the bit can dampen vibrations, increase rate of penetration, and/or improve steerability of the bit. The side rake angles of two or more adjacent primary cutters along each of the offset blades in the illustrated examples are may be set to cause the generation opposing or counteracting lateral forces along the blade while engaging a formation. Furthermore, one or more primary cutters along one blade may coordinate or cooperate with one or more cutters on other blades with different side rake angles in a way that reactive lateral forces are created on the bit that counteract each other in ways that dampen bit vibration. For example, these could be radially adjacent or overlapping primary cutters on different blades. Or, for example, the side rakes of the primary cutters within each of two or more groups of primary cutters on the bit can be chosen to generate lateral forces that counteract each other to dampen lateral vibrations or to improve direction control and steerability. The cutters are grouped by, for example, radial positions within the cutting profiles, the region of the bit in which they are located (e.g. cone, nose, shoulder), angular position, location along a blade, by adjacency along a blade or in the bit's cutting profile, or a combination of two or more of these parameters.

A primary cutter that is rotated to give it side rake (either inwardly toward the axis of rotation or outwardly toward the gauge) requires more room than a cutter that has no side rake due to the cutters having both a length, as measured along the central axis, and diameter (substrate and cutting face. There is also a minimum separation that is required to form a pocket or recess formed within the blade for mounting the cutter that has sufficient strength. Furthermore, the areas of the formation between areas removed adjacent by cutters on the same blade must be removed by primary cutters on other blades. Too great a separation of adjacent primary cutters on a blade is not desirable, especially in the cone region of a PDC bit, where there is a lower concentration of cutters. Therefore, there is a limit on the amount of side rake that a cutter can be set at without having to reduce the number of cutters on a blade, to limit the side rake angles of at least adjacent cutters on the same blade, and/or to necessitate trade-offs that might adversely affect bit performance.

Referring now to FIG. 3, the first primary cutter 318 on the outer blade portion of each offset blade 326 is set back far enough with respect to last primary cutter 316 on the inner blade portion to allow more spacing to rotate cutters on the inner blade portion to increase side rake angles without being limited by cutter 318. Thus, as compared to a non-offset blade of these length and same number of cutters of the same size, the offset allows not only for the primary cutters 314-316 on the inner blade portion more space to allow for larger side rake for any one or more of the primary cutters on the inner blade portion, but also for larger differences in side rake angles between any two adjacent pairs, or between any two or more of them, without having to shift the radial position of primary cutter 318.

In the illustrated example, the primary cutters 314 appear to be rotated more inwardly than cutters 312 and 316, and thus has a more inward side rake, with the cutter 314 being rotated inwardly with respect to cutter 312, and cutter 316 being rotated outwardly relative to the side rake of cutter 314. All three primary cutters are in the cone region of the blade.

As compared to a non-offset blade with the same cutters and the size bit diameter, the offset also allows the last primary cutter 316 to be rotated to relatively higher side rake without (1) being limited by first primary cutter 318 on the outer blade portion or (2) having to change the radial locations or side rakes of the primary cutters 312 and 314 on the inner blade portion and/or primary cutter 318. Furthermore, the offset in the blade moves primary cutter 318 rotationally backward and exposes the side of cutter 316 to the formation to provide an additional lateral point of contact with the formation that can be used to improve bit stability. The offset also allows for first primary cutter 318 on the outer blade portion to be given a much higher (non-zero) side rake angle than would otherwise be possible and/or for its radial position moved slightly inwardly as compared to a non-offset blade. For similar reasons, the offset allows for more spacing and greater side rake angles for a primary cutter, and/or larger differences in side rake angles between two or more adjacent primary cutters or any two primary cutters, on the outer blade portions of the offset blades. Finally, the offset also allows for the difference in side rake between last primary cutter 316 on the inner blade portion and the first primary cutter 318 on the outer blade portion to be much greater. Because of the offset in blade 326, cutters 316 and 318 are rotationally offset to a degree that they can be rotated without affecting the other's orientation.

Referring now to FIG. 4, the offset blades 426 and 450 are similar to blades 326 of bit 310 (FIG. 3) and have the same advantages. However, offset blade 426 also demonstrates an additional advantage of accommodating at least a partial overlapping of primary cutters on an offset blade. The degree of angular offset or step between the distal end of the inner blade portion and proximal end of the outer blade portion is larger relative to the degree of angular or rotational offset between the blade portions of offset blade 326 of FIG. 3 and offset blades 450 of FIG. 4. Furthermore, the distal end of the inner blade portion overlaps with the proximally end of the outer blade portion. This structure allows the cutting profile of primary cutter 416, the last cutter on the inner blade portion of the offset of blade 426, to overlap at least partially the cutting profile of the first primary cutter 418 on the outer blade portion of offset of blade 426. The side rakes of primary cutters 416 and 418 can thus each be set without concern for spacing between them.

Offset blade 426 therefore allows overlapping of primary cutters on the same blade. Primary cutter 418 has the same exposure to the formation as other primary cutters on the blade and is on the primary cutting profile for the bit. It also has access to junk slot 434 and to the drilling fluid flowing within junk slot 434 for evacuating cuttings it produces. Furthermore, the blade's geometry allows the primary cutter 416 and primary cutter 418 to each be rotated to even larger side rake angles than might be have been possible on one of the other offset blades. These cutters do not interfere with each other and thus will not limit each other in terms of the degree of rotation even though they are on the same blade. Furthermore, the overlapping allows for additional spacing one or both of the inner and outer blade portions. More room on each blade portion of the offset blade allows greater side rake angles of one or more of the primary cutters each blade portion and allows for larger side rake differences between adjacent cutters.

Referring now also FIG. 3 in addition to FIG. 4, PDC bits 310 of FIG. 3 and 410 of FIG. 4 are examples of rotary drag bits with cutter side rake schemes for generating counter acting lateral forces that tend to dampen vibration, improve cutting efficiency, improve ROP, and/or otherwise improve bit performance. Such cutter rake schemes may embody one or more of the following:

(1) A pair or a set of three or more primary cutters mounted on one or more leading edges of one or more offset blades with side rakes that generate counteracting lateral forces on the bit. The pair or set of cutters are mounted, in one embodiment, on the same offset blade or, in another embodiment, on different offset blades. If they are on different offset blades, the cutters in the pair or the set of three or more may be in radially adjacent positions on the bit's primary cutting profile. The pair or set of cutters are, in one embodiment, primary cutters that are adjacent to each other on the same offset blade and, optionally be in radially adjacent locations on the bit's primary cutting profile, and/or partially or completing overlapping in the primary cutting profile. An offset blade like offset blade 426 allows primary cutters to be both adjacent on the offset blade and in radially adjacent locations and/or partially or completely overlapping in the cutting profile.

(2) A group of two or more primary cutters on one offset blade with side rake angles set to generate counteracting lateral forces on the bit during drilling. All of the cutters in the group may be in one the following locations: in the cone section of the bit; on opposite sides of the offset in the offset blade; on the first or inner blade portion on the offset blade; or on the second or outer blade portion of the offset blade. The cutters in the group are, in one embodiment, adjacent to each other on the offset blade, and in another embodiment are not adjacent. Primary cutters on an offset blade may have non-zero side rake angles. Primary cutters on non-offset blades, including secondary blades, may also have such a group of one or more cutters. Furthermore, one or more primary cutters on an offset and one or more non-offset blades may form a group of cutters with side rake angles.

(3) Three cutters in a group of three or more cutters that have side rake angles that vary in polarity (positive and negative, positive and zero, and negative and zero) or a change in the side rake of the cutters by rotation inwardly or outwardly relative to another (high positive and low positive, high negative and low negative). For example, if there are three cutters, the second cutter and rotated laterally outwardly relative to the first cutter, and cutter three then rotated inwardly relative to cutter the second cutter. The cutters may be adjacent to each other along a blade, radially adjacent to each other in a cutting profile, or possibly both.

(4) A pair of adjacent cutters have side rakes that are negative and positive, high positive and low positive, high negative and low negative, negative and zero, or positive and zero and face each other or turn away from each other.

(5) Multiple groups of three or more cutters with side rakes are set to generate counteracting lateral forces on the bit. Side rakes of cutters in a group, particularly those that are adjacent on a blade or in a cutting profile may change polarity or exhibit relatively large changes between them.

(6) All of the primary cutters on the bit in particular region or on a blade or on multiple blades of a bit have a distribution of side rake angles (the number of cutters at each side rake angle or a range of side rake angles) that is bimodal or that has multiple maxima. Examples of regions or particular blades include all primary cutters in the cone, cone and nose, nose and shoulder, or cone, nose and shoulder regions; all such primary cutters in the region on offset blades; all primary cutters on any two blades; all primary cutters on one or more offset blades; all primary cutters on one or more offset and one or more non-offset blades; all primary cutters on two or more offset blades; and all primary cutters on the bit.

(7) The magnitude of the differences in side rake angles between at least three, and up to all, of the cutters that are radially adjacent along a blade or that are radially adjacent in at least a portion or region of a bit's cutting profile are mostly, if not always, non-zero and relatively constant in magnitude and/or not less than a certain value. In different embodiments, the differences are 3 or more degrees; 5 or more degrees plus or minus two degrees; and at least 7 degrees. In different embodiments, averages of these differences are at least 3 degrees; at least 5 degrees; and at least 7 degrees. With primary cutters on offset blades, the values of these differences, the minimum value of the differences, and/or the average value of these difference can be made greater than with a conventional blade. Examples of regions include all primary cutters on at least offset blades in the cone, cone and nose, nose and shoulder; and cone, nose and shoulder regions.

Each of the foregoing embodiments of rotary drag bit may have two cutters in a group of two or more fixed cutters, which can be radially adjacent in the cutting profile or on a blade, with large differences in side rake angles. In one example, a large difference between the side rake angles of two cutters is at least 4 degrees or more; in another example at least 7 degrees or more; and in another example at 10 degrees or more; and in another example at least 13 degrees or more.

Unless otherwise noted, differences between side rake angles between a first cutter and a second cutter that are negative indicate that second cutter is turned more inwardly than first cutter. If it is positive, it means that the second cutter turn is turned more outwardly than the first cutter. Thus, a change from −2 degrees to +2 degrees, or from −11 to −7, is a +4 degree difference. A change from +2 to −2 degrees or a change from 11 to 7, is a −4 degree difference. However, if no polarity is indicated, the change or delta should be interpreted as a scaler quantity, without regard to the direction of change. Furthermore, "small side rake angle" and a "large side rake angle" each refer to the scalar value of the angle, meaning the amount of side rotation from the zero angle. Thus, to say that the cutter has high or large side rake angle means that it has a negative or a positive side rake angle with a large value.

Figure 5A:
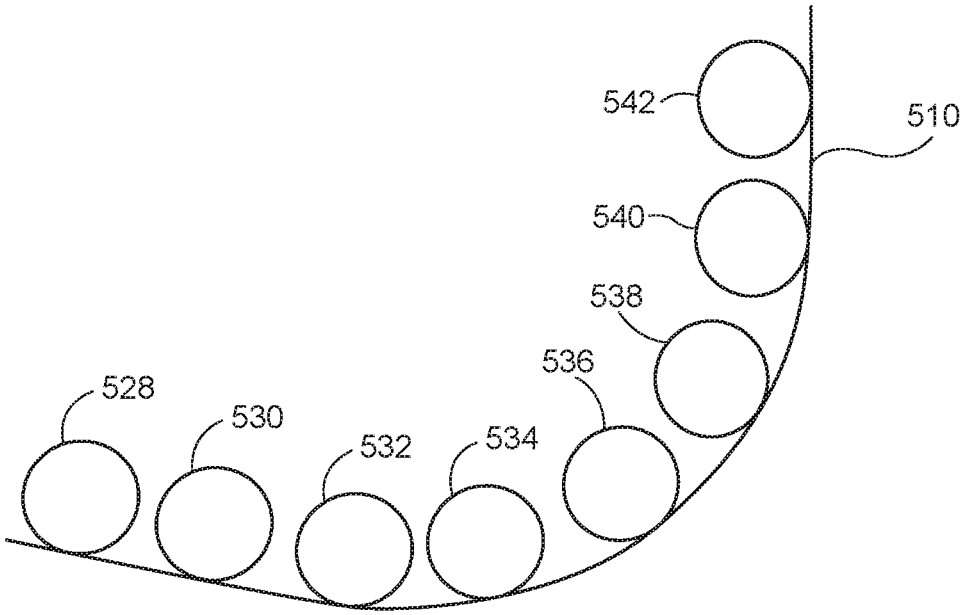
FIG. 5A is a cutting profile for a first example of cutters mounted on an offset blade.
Figure 5B:
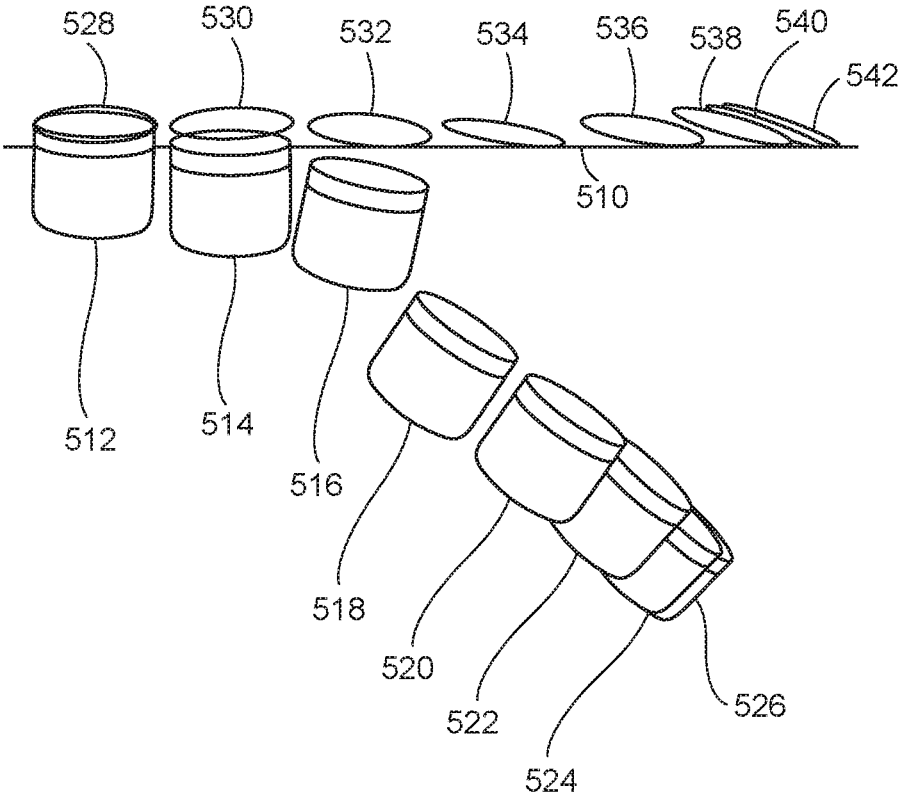
FIG. 5B illustrates a three dimensional cutter geometry corresponding to the cutting profile of FIG. 5A.

FIGS. 5A and 5B depict the cutter geometry (FIG. 5B) of cutters 512, 514, 515, 518, 520, 522, 524 and 526 on an offset blade (not shown) of a rotary drag bit (not shown) with an offset blade geometry like the offset blades 326 and 450 in FIGS. 3 and 4. Cutters 512-525 are depicted as they would be when mounted along a leading edge on an offset blade, with the offset located between cutters 516 and 518. A profile 528-542 corresponding to cutting face of each cutter 512-526, respectively, is indicated in relation to a primary cutting profile 510 for the bit, which shows that each of the primary cutter are on the primary cutting profile.

From FIG. 5B the side rake of each of the cutters can be appreciated. For example, cutter 512 has a positive side rake angle that orients the face of cutter 512 laterally outwardly. Cutter 514 is rotated inwardly and has a negative side rake. Cutter 516 is rotated outwardly as compared to cutter 514. The cutter geometry illustrates that each blade portion of the offset blade (the inner and outer) allows more room for turning or rotating the cutters to achieve the desired side rake scheme. As can be seen in FIG. 5*a*, the profiles of the cutters are relatively evenly spaced along the blade. However, without the offset between them, the outward rotation of cutter 516 and the further outward rotation of cutter 518 would not have been possible. If cutters 516 and 518 were next to each other on a conventional blade, cutter 516 and the minimum spacing requirement would interfere with the rotation of cutter 516 to a high side rake angle.

Figure 6A:
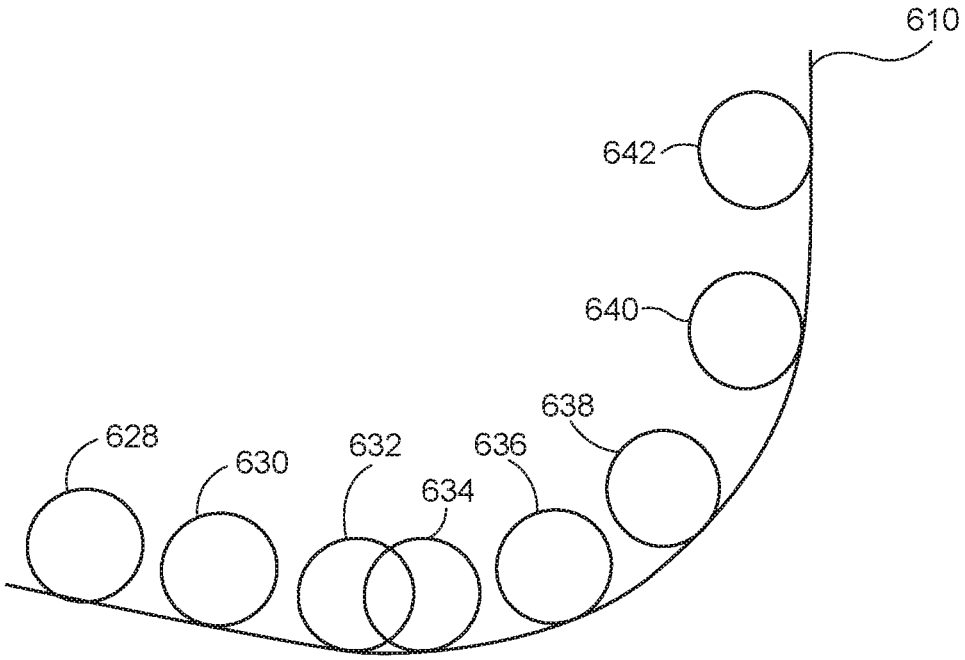
FIG. 6A represents a cutting profile of a second example of a cutter geometry for an offset blade.
Figure 6B:
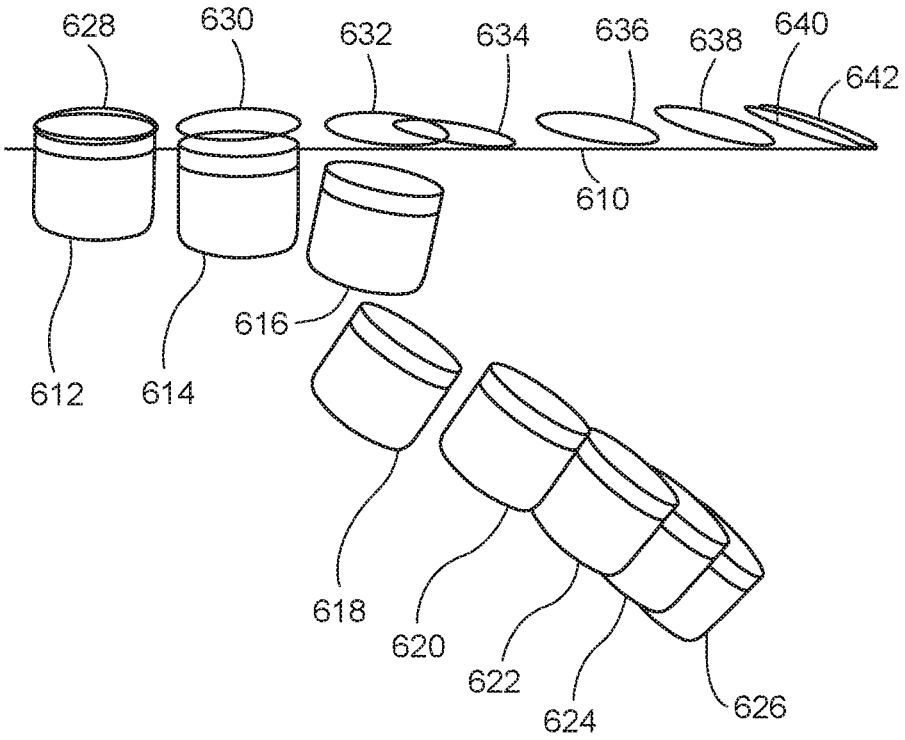
FIG. 6B illustrates the cutter geometry corresponding to the cutting profile of FIG. 6A.

FIGS. 6A and 6B illustrate an example of cutter geometry and cutter profile of primary cutters 612-626 mounted along a leading edge of an offset blade (not shown) like offset blade 426 of FIG. 4. Cutters 612-616 are mounted on a first or inner blade portion of the offset blade; cutters 618-626 are mounted on the second or outer portion of the offset blade. As indicated by the profiles 628-642 that correspond, respectively, to cutters 612-626, the cutters are on a primary cutting profile 610. As indicated by the overlapping of cutter profiles 632 and 634, primary cutters 616 and 618 are partially overlapping, like cutters 416 and 418 on the offset blade 426 in FIG. 4. Furthermore, the difference in side rake angles of primary cutters 616 and 618 is relatively large—much larger than would be possible on a conventional blade or an offset blade like those in FIG. 3. Although not indicated in this example, the overlapping cutters may allow for additional cutters to be placed on the outer blade portion of the offset blade.

The additional space afforded by the offset blade allows for side rake scheme in which blade-adjacent cutters 612-616 on the inner blade portion of the offset bit, which is in the cone region of the bit, are turned or oriented to give any two (adjacent or non-adjacent) of them larger differences in side rake angles than what would be possible with a non-offset or conventional blade, and to employ side rake schemes with that would otherwise not be possible. Larger differences in side rake angles will tend to result in larger counteracting lateral forces on the bit in a region of the cone where counteracting lateral forces tend to have greater effect on dampening vibration and improving cutting performance of the bit. Specifically, in this example cutter 612 is turned outwardly, cutter 614 is turned inwardly to face cutter 612, and cutter 616 is turned outwardly, each by a significant amount. Such a side rake scheme, with the large changes in side rake, likely would have not be possible on cutters on the same blade, particularly within the cone region, without spacing apart the cutters more and possibly having to reduce the number of cutters on the blade, or without applying the scheme instead to a group of radially adjacent primary cutters spread across multiple blades.

Figure 7:
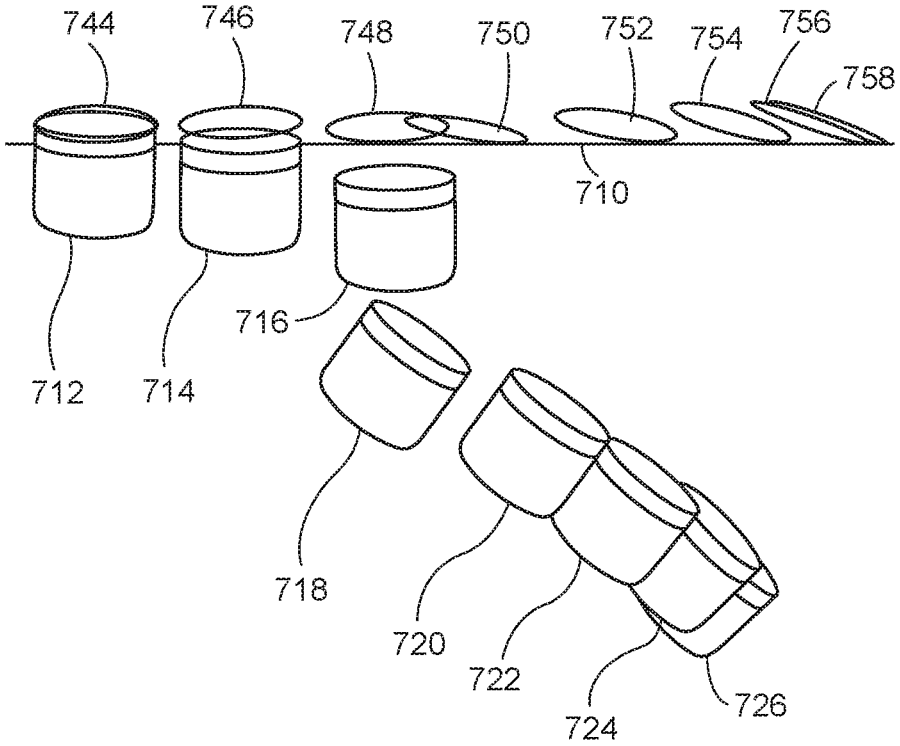
FIG. 7 illustrates a cutter geometry of a third example of an offset blade.

FIG. 7 is another example of a cutter geometry an offset blade (not shown) of a rotary drag bit, in particular a PDC bit. Primary cutters 712, 714, 716, 718, 720, 724, and 726 are mounted along a leading edge of an offset blade similar offset blade 426, with an offset between the third and fourth primary cutters on the blade, which are cutters 716 and 718. Cutter profiles 744, 746, 748, 750, 752, 754, 756 and 758 that correspond to the cutters show that they are on the bit's primary cutting profile 710. As indicated by the cutter profiles 748 and 750, the primary cutters 716 and 718 are adjacent. Because they overlap, a bit designer is able to set the side rake angles of the cutters to opposite polarities give one or both a high side rake angle. In this example, primary cutter 716, which is the third cutter on the blade, has a side rake angle of negative 7 degrees. Cutter 718 has a side rake angle of 10 degrees, a difference of 17 degrees. In these cutters where on a non-offset blade and set close to the minimum separation needed for mounting them on the blade, it would not possible to achieve such a large difference in side rakes close to minimum separation. The largest negative side rake for the third cutter (cutter 716) would be negative one degree and the maximum positive side rake of the fourth cutter (cutter 718) would be five degrees, only a 6 degree difference.

The graphs of FIGS. 8A to 8G illustrate various examples of side rake schemes for fixed cutters on a rotary earth boring tool, such as a PDC bit or reamer, that illustrate or embody patterns relative side rake angles or changes in side rake changes between cutter that can be used on bits with offset blades for generating counteracting lateral forces on the tool. The x-axis represents successive positions of cutters along a blade or, in an alternative embodiment, successive radial locations of cutters or cutter positions in a bit's cutting profile. An offset blade can be used to increase the side rake angles and differences in side rake angles.

The origin represents, in some embodiments, the axis of rotation of the tool, with successive positions along the x axis representing positions closer to the gauge of the body of the tool and more distant from the axis of rotation. However, the patterns could start at some outer location within the cutting profile or blade. The number of cutters on a bit depends, at least in part, on the size of the bit. The number of data points indicated along the x axis is therefore not intended to be limiting, but representative of a side rake scheme embodying examples of patterns can be used on bits with offset blades for generating counteracting lateral forces on a rotary earth boring with fixed cutters. The y axis indicates the side rake angle of the cutters. The graphs are not intended to imply any particular range of positions on a blade or within a cutting profile. Furthermore, although primary cutters are assumed for the exemplary side rake schema, the patterns in side rake that they embody could be used in side rake schema for a row of backup cutters or cutters on a secondary cutting profile, or a combination of both.

Figure 8A:
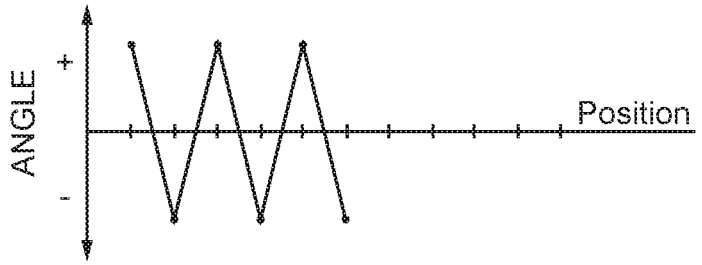
FIG. 8A-8J are graphs plotting cutter position to a side inclination, such as a side rake or lateral angle, and represent examples of schemes or patterns of such angles across a blade or cutting profile of an earth boring tool with fixed cutters.

The example of FIG. 8A represents a side rake scheme in which the differences or changes in side rake angles of at least three cutters in adjacent positions alternate directions. For example, the angle of the cutter in the first position and the angle of the cutter in the second position have opposite polarities. The direction of change or the difference is negative. The change between the cutters in the second and the third positions is a direction opposite the direction of the change from the first to the second cutter. The side rake angle increases, and the difference is positive.

Figure 8B:
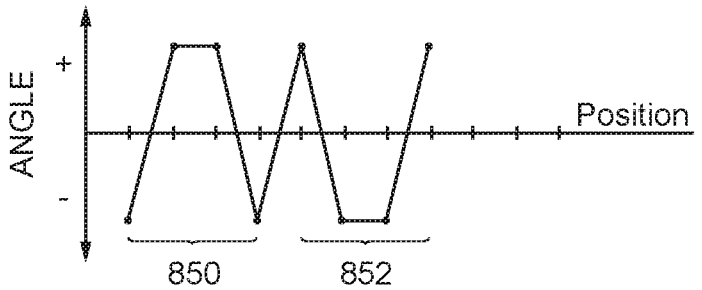

The example of FIG. 8B is similar to FIG. 8*a*, except that it is comprised of two related patterns 850 and 852, which are the inverse of each other. In each of these two patterns the change of the side rake from an individual cutter to a group of two or more cutters with a similar side take is in one direction, and then the change in angle from the group to a single cutter is in the opposite direction.

Figure 8C:
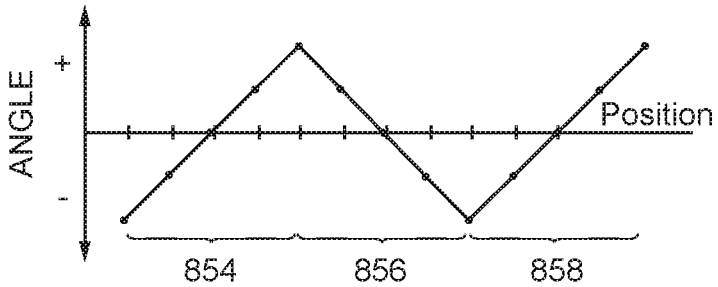

In the example configuration of FIG. 8C, the differences in side rake angles within group 854 of at least two successive cutters, four in this example, is in a first direction. The angle in this group progressively increase, in this example from negative to positive. In a next adjacent group 856 of two or more cutters, the side rake angles change in the opposite direction between adjacent members of cutters within that group. In this example, the angles decrease, and furthermore they decrease from being positive angles to negative angles. A third group of at least cutters 858, having increasing angles, and thus the direction of change in angle within this group is positive. The pattern thus illustrates an alternating of the direction of change within adjacent groups of cutters.

Figure 8D:
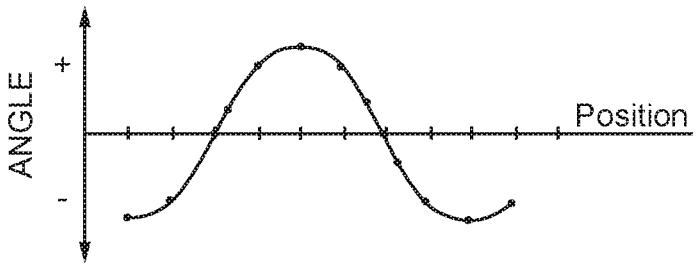

FIG. 8D is similar to FIG. 8C, except that the changes in side rake angles follow a sinusoidal pattern rather than a linear pattern.

Figure 8E:
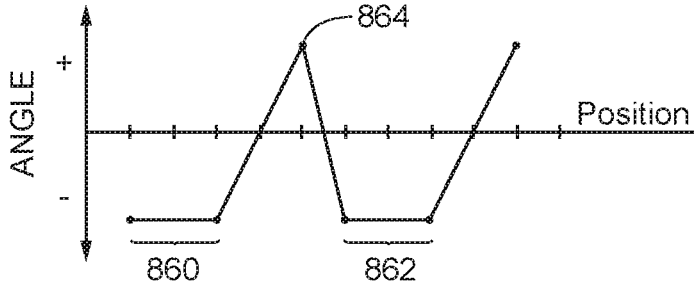

FIG. 8E shows an example of a pattern in which the side rake angles within groups 860 and 862 of two or more successive cutters are similar, for example, all the same magnitude or all negative or positive, but that every third or more cutter 864 has a different angle, for example, positive when the angles in the group 860 are negative. The angles change in a first direction from group 860 to cutter 864, and then in the opposite direction between cutter 864 and group 862. Inverting the pattern is an alternative embodiment. The cutter having one polarity of side take might be positioned on one side of the bit and the cutters with the opposing polarity would be positioned on the other side of the bit. For instance, one side rake would be used on blades 1 to 3 and the second side rake would be used for cutters on blades 4 to 6 of a six bladed bit.

Figure 8F:
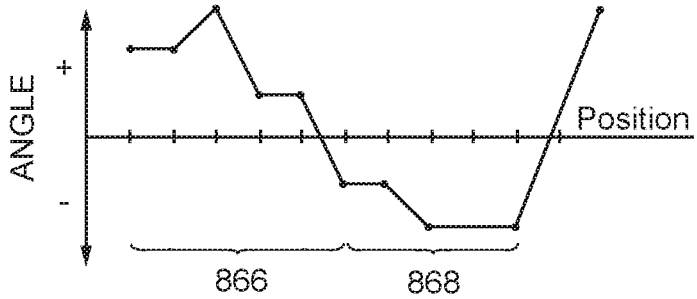

FIG. 8F is an example of a pattern for a bit in which side rakes of two or more adjacent cutters within group 866, for example within a cone of a bit, are positive, and then a group of two or more adjacent cutters are negative in an adjacent group 868. The second group could be, for example, along the nose and shoulder of the bit. The side rake angle then becomes positive again. The pattern also illustrates stepwise decreases or increases of side rake within a group.

Figure 8G:
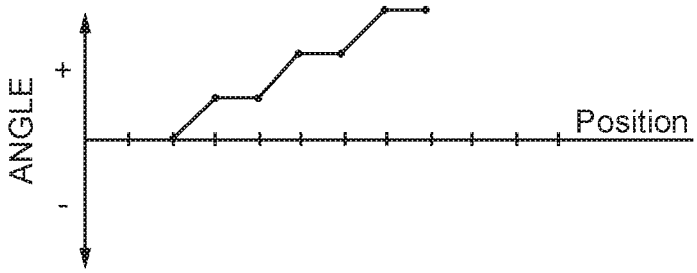

FIG. 8G is an example of a step wise pattern or configuration in which the side rake angle is generally increasing. In this example, the side rake angle is increasing generally in a non-linear fashion, but the change in angle swings between an increasing direction and a neutral direction. In this example the increasing positive side rake pushes cuttings increasingly to the outer diameter of the but, increasing drilling efficiency.

Alternative embodiments to the patterns or configurations of FIGS. 8A to 8D comprise inverting the patterns. Furthermore, although the polarity of the angles (positive or negative) form part of the exemplary patters, the values of the angles in alternative embodiments can be shifted positive or negative directions without changing the polarity of the sides of the cutters in the grouping. In the configuration of FIG. 8A, for example, the cutters could have either all positive or all negative side rake while employing alternating changes in direction of the differences between the cutters. Furthermore, the alternating a pattern of positive and negative direction changes could occur first between cutters with positive angles, and then between cutters with positive and negative side rake angles, and then between cutters with only negative side rake polarities, all without interrupting the alternating pattern. Another embodiment is a bit with, for instance, blades 1 to 3 having one side rake and blades 4 to 6 having an opposing or substantially different side rake, similar to the arrangement shown in FIGS. 8E and 8F. This design could recede walk tendency, and might be configured to be more laterally stable than a more conventional design.

Figure 8H:
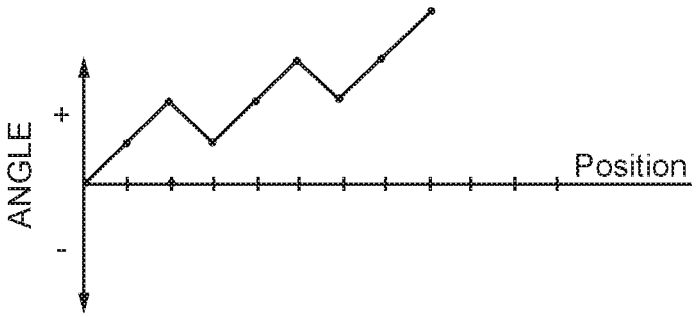
Figure 8I:
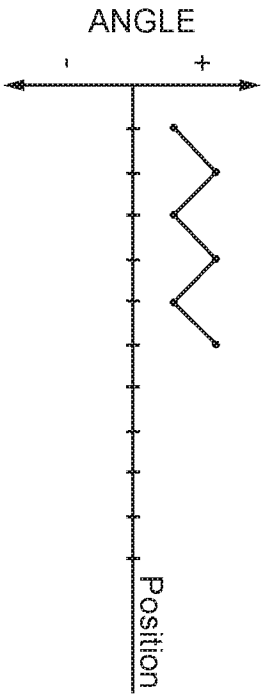
Figure 8J:
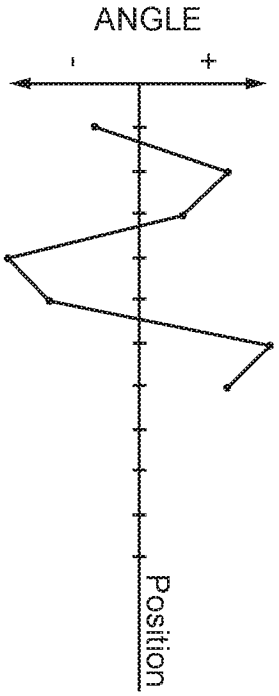

FIGS. 8H and 8J are additional examples of alternative patterns. In FIG. 8H, the side rake angles are positive and generally increase. But, at some frequency, the angle decreases. In this example, the frequency is every third cutter in the sequence. However, a different frequency could be chosen, or the point at which the decrease occurs can be based on a transition between section of the bit or blade, such as between cone and nose, nose and shoulder, and shoulder and gauge, or at a blade offset FIG. 8I is an alternative embodiment to FIG. 8A, in which the side rake angles remaining positive, but increase and decrease in alternating fashion.

FIG. 8I is an alternative embodiment to FIG. 8A in which the side rake angles remaining positive but increase and decrease in an alternating fashion.

FIG. 8J illustrates that patterns of side rake angles changes may also involve varying the magnitude of change in the side rake angle between cutters in addition to direction.

Figure 9A:
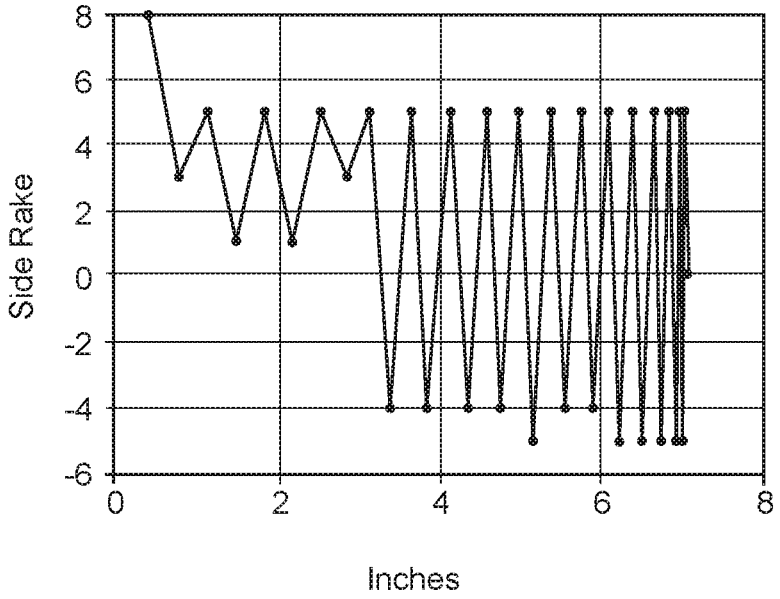
FIG. 9A is a graph plotting primary cutter radial positions to side rake angle in degrees for cutters on an example of a PDC bit with offset blades.
Figure 9B:
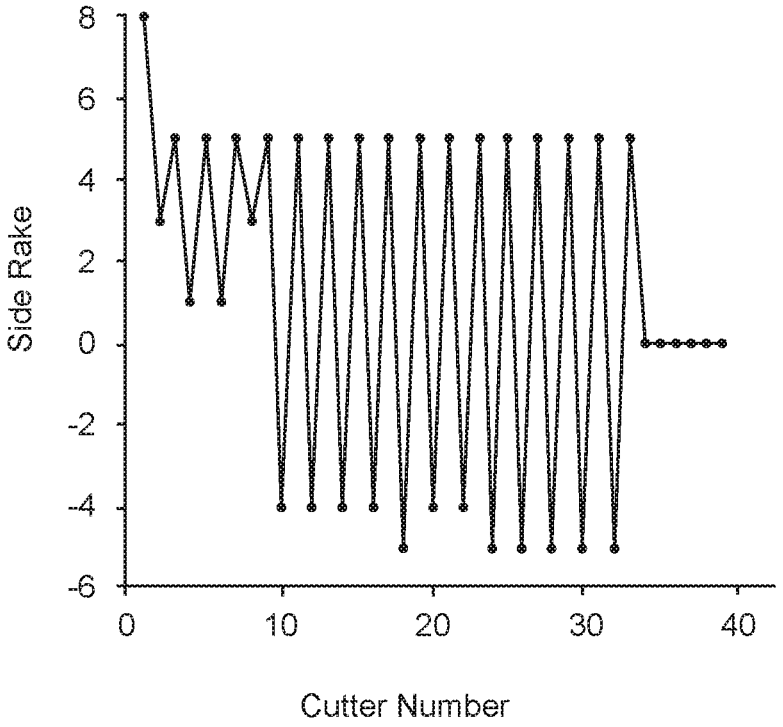
FIG. 9B is a graph plotting cutter number to side rake angle for the example of FIG. 9B.

FIGS. 9A and 9B depict the side rake schema of an example of a PDC bit with offset blades as primary blades with a side rake schema for its primary cutters embodying patterns that generate counteracting lateral forces on the bit that tend to reduce or dampen vibration that reduces bit cutting performance. The PDC bit is be a representative, non-limiting example of a rotary drag bit with fixed cutters and offset blades.

FIG. 9A plots side rake angle against radial location of the primary cutters; FIG. 9B plots side rake angle against cutter number for the same primary cutters. Table 1 below gives the values of side rake, cutter number, blade number and bit profile region (which can be used to determine in what region the cutter is located on the blade) for each of the bit's primary cutters. The bit has three primary blades, each of which is an offset blade, and the offsets for the blades occur within the cone region between the second and third cutters on each primary blade.

TABLE 1

| Cutter No | Region | Side Rake (deg.) | Blade Number |
|---|---|---|---|
| 1 | Cone | 8 | 1 |
| 2 | Cone | 3 | 5 |
| 3 | Cone | 5 | 3 |
| 4 | Cone | 1 | 1 |
| 5 | Cone | 5 | 5 |
| 6 | Cone | 1 | 3 |
| 7 | Cone | 5 | 1 |
| 8 | Cone | 3 | 5 |
| 9 | Cone | 5 | 3 |
| 10 | Cone | −4 | 2 |
| 11 | Cone | 5 | 1 |
| 12 | Nose | −4 | 5 |
| 13 | Nose | 5 | 4 |
| 14 | Nose | −4 | 3 |
| 15 | Nose | 5 | 2 |
| 16 | Nose | −4 | 1 |
| 17 | Nose | 5 | 6 |
| 18 | Nose | −5 | 5 |
| 19 | Shoulder | 5 | 4 |
| 20 | Shoulder | −4 | 3 |
| 21 | Shoulder | 5 | 2 |
| 22 | Shoulder | −4 | 1 |
| 23 | Shoulder | 5 | 6 |
| 24 | Shoulder | −5 | 5 |
| 25 | Shoulder | 5 | 4 |
| 26 | 52.49 | −5 | 3 |
| 27 | Shoulder | 5 | 2 |
| 28 | Shoulder | −5 | 1 |
| 29 | Shoulder | 5 | 6 |
| 30 | Shoulder | −5 | 5 |
| 31 | Shoulder | 5 | 4 |
| 32 | Shoulder | −5 | 3 |
| 33 | Shoulder | 5 | 2 |
| 34 | Gauge | 0.01 | 1 |
| 35 | Gauge | 0.01 | 6 |
| 36 | Gauge | 0.01 | 5 |
| 37 | Gauge | 0.01 | 4 |
| 38 | Gauge | 0.01 | 3 |
| 39 | Gauge | 0.01 | 2 |

In this example, the side rakes of the primary cutters alternate in magnitude or alternate in both magnitude and polarity along the cutting profile of the bit. Thus, radially adjacent cutters on the primary cutting profile have alternating side rakes that provide an alternating series of positive and negative changes in side rake angle. Similarly, the cutters on the inner blade portion and the first cutter on the lower blade portion of at least two of the primary blades have large difference in side rake angles that alternate from positive to negative, with the largest change being negative seven degrees. Alternating negative and positive differences occur between cutters with positive side rake angles in the cone region, and that the alternating pattern of side rakes in the nose and shoulder regions occurs between primary cutters with positive and negative side rakes.

Figure 10A:
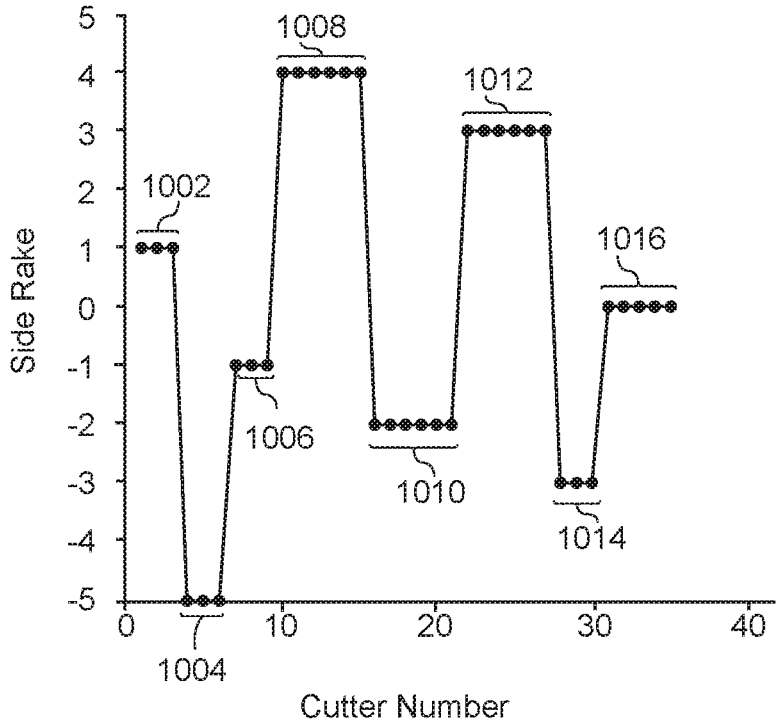
FIG. 10A is a graph plotting cutter radial position to side rake angle in degrees for cutters on second example of a PDC bit with offset blades.
Figure 10B:
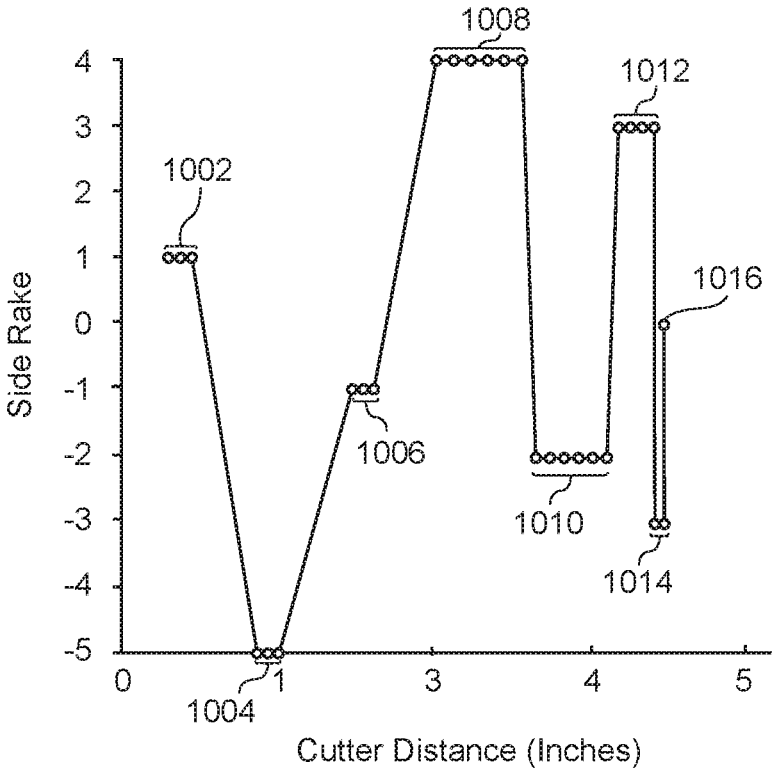
FIG. 10B is a graph plotting cutter number to side rake angle for the example side rake scheme of FIG. 10B

FIGS. 10A and 10B are graphs that plot, respectively, side rakes of primary cutters against cutter number and cutter position in a primary cutting profile of a PDC bit that is intended to be another representative, non-limiting example of a rotary drag bit with fixed cutters and offset blades. This example has 6 blades, with blades 1,3 and 5 being primary blades with offset geometries. The offsets occur between the third and fourth cutters on blades in the nose region. Table 2 below gives the values of size rake, radial location, and cutter number, as well as angular position, blade number and profile angle (which can be used to determine in what region the cutter is located on the blade) for each of the bit's primary cutters.

TABLE 2

| Cutter No | Profile Angle (deg.) | Side Rake (deg.) | Blade Number |
|---|---|---|---|
| 1 | Cone | 1 | 1 |
| 2 | Cone | 1 | 5 |
| 3 | Cone | 1 | 3 |
| 4 | Cone | −5 | 1 |
| 5 | Cone | −5 | 5 |
| 6 | Cone | −5 | 3 |
| 7 | Nose | −1 | 1 |
| 8 | Nose | −1 | 5 |
| 9 | Nose | −1 | 3 |
| 10 | Nose | 4 | 2 |
| 11 | Shoulder | 4 | 1 |
| 12 | Shoulder | 4 | 6 |
| 13 | Shoulder | 4 | 5 |
| 14 | Shoulder | 4 | 4 |
| 15 | Shoulder | 4 | 3 |
| 16 | Shoulder | −2 | 2 |
| 17 | Shoulder | −2 | 1 |
| 18 | Shoulder | −2 | 6 |
| 19 | Shoulder | −2 | 5 |
| 20 | Shoulder | −2 | 4 |
| 21 | Shoulder | −2 | 3 |
| 22 | Shoulder | 3 | 2 |
| 23 | Shoulder | 3 | 1 |
| 24 | Shoulder | 3 | 6 |
| 25 | Shoulder | 3 | 5 |
| 26 | Shoulder | 3 | 4 |
| 27 | Shoulder | 3 | 3 |
| 28 | Shoulder | −3 | 2 |
| 29 | Shoulder | −3 | 1 |
| 30 | Gauge | −3 | 6 |
| 31 | Gauge | 0.01 | 5 |
| 32 | Gauge | 0.01 | 4 |
| 33 | Gauge | 0.01 | 3 |
| 34 | Gauge | 0.01 | 2 |
| 35 | Gauge | 0.01 | 1 |

The three cutters along the inner blade portions and the first cutter on the outer blade portion change in alternating directions, with side rake differences of least 4 degrees. Cutters in the bit profile form groups of cutters (with at least three cutters in each group) 1002, 1004, 1006, 1008, 1010, 1012, 1014, and 1016 that have the same side rake angles (in alternative embodiments, the angle may different slightly), with relatively large side rake angle differences between groups, with the direction of change alternating between positive and negative between successive groups along the bit's cutting profile, except the two changes between group 1004 and 1006 and 1006 and 1008, both of which of are positive. These patterns of side rake angles help to generate counteracting lateral forces on the bit that dampen bit vibration.

The foregoing are representative, non-limiting examples of downhole tools. Each example may embody several improvements, each of which might be separately claimed or claimed in different combinations. Furthermore, an example is not intended to limit of the scope of a claim to an improvement to the details of the example, as modifications can be made to the examples by those of ordinary skill in the art while still embodying a claimed improvement. The appended claims are not intended to be construed to be limited only to a specific example where their literal language permits a broader construction consistent with the specification set forth above.

What is claimed is:

1. A drill bit to advance a borehole comprising:

a bit body having a central axis about which the bit is intended to rotate, the body having a gauge and a cutting face on which is formed a plurality of radially extending blades that are separated from each other by channels, each of the plurality of blades supporting a plurality of discrete, fixed cutters for shearing rock along a leading edge of each of the blades next to one of the channels to evacuate rock shavings; each of the cutters having a fixed location on one of the plurality of blades, a fixed cutter position in a cutting profile that is defined at least in part by the plurality of cutters, and a fixed side rake angle, the side rake angle having a polarity that can be negative, positive, or zero;

wherein:

at least one of the blades is an offset blade that extends radially outwardly from near the central axis toward the gauge and has a leading front edge adjacent to one of the channels, the blade having a first section and at least one second section that is radially and angularly displaced from the first section;

at least two of the plurality of cutters are mounted along the leading edge in the first section and at least two of the plurality of cutters are mounted along the leading edge of the second section;

the at least two cutters in the first section and the at least two cutters in the second section each form a group of cutters the at least two cutters in each group of cutters have side rake angles that differ from one another by at least 4 degrees; and the polarity of the side rake angle of a particular cutter of the at least two cutters within each group of cutters differs from the polarity of the side rake angle of a different cutter of the at least two cutters within each group of cutters.

2. The drill bit of claim 1, wherein at least one cutter within the group of cutters is adjacent on the offset blade to another cutter in the group of cutters.

3. The drill bit of claim 2, wherein all of the cutters within each group of cutters are adjacent to each other on the offset blade.

4. The drill bit of claim 2, wherein the at least one cutter within the group of cutters is adjacent in the cutting profile to another cutter in the group of cutters.

5. The drill bit of claim 4, wherein all of the cutters within the group of cutters are adjacent in the cutting profile to another cutter in the group of cutters.

6. The drill bit of claim 1, wherein the bit body has a cone, a nose, a shoulder, and the gauge and all of the cutters within the group of cutters are located within one of the cone, the nose, the shoulder, or the gauge.

7. The drill bit of claim 1, wherein the side rake angle of each cutter in the group of cutters is defined by the angular orientation of a cutting face of the cutter about an axis that is normal to a tangent to the cutting profile at the radial position of that cutter.

8. The drill bit of claim 1, wherein the side rake angle of each cutter in the group of cutters is defined by the angular orientation of a cutting face of the cutter about an axis that is normal to the tangent to the cutting profile at the radial position of that cutter projected onto the plane of the cutting face.

9. The drill bit of claim 1, wherein the particular cutter and the different cutter are adjacent one another.

10. A drill bit to advance a borehole comprising:

a bit body having a central axis about which the bit is intended to rotate, the body having a plurality of radially extending blades that are separated from each other by channels, each of the plurality of blades supporting a plurality of cutters; each of the cutters having a fixed location on one of the plurality of blades, a fixed cutter position in a cutting profile that is defined at least in part by the plurality of cutters, and a fixed side rake angle, the side rake angle having a polarity that can be negative, positive, or zero;

wherein, at least one of the blades is an offset blade that has a leading edge adjacent to one of the plurality of channels, the blade having a first section and a second section where the second section is radially and angularly displaced from the first section;

wherein, the plurality of cutters comprises at least one group of two or more primary cutters mounted in a row along the leading edge of the offset blade, wherein at least two primary cutters in the group of cutters have side rake angles that differ from one another by at least 4 degrees; and wherein the polarity of the side rake angle of a particular cutter of the at least two cutters within the group of cutters differs from the polarity of the side rake angle of a different cutter of the at least two cutters within the group of cutters.

11. The drill bit of claim 10, wherein at least one cutter within the group of cutters is adjacent on the offset blade to another cutter in the group of cutters.

12. The drill bit of claim 11, wherein all of the cutters within the group of cutters are adjacent to each other on the offset blade to another cutter in the group of cutters.

13. The drill bit of claim 10, wherein the at least one cutter within the group of cutters is adjacent in the cutting profile to another cutter in the group of cutters.

14. The drill bit of claim 13, wherein all of the cutters within the group of cutters are adjacent in the cutting profile to another cutter in the group of cutters.

15. The drill bit of claim 10, wherein the bit body has a cone, a nose, a shoulder, and a gauge and all of the cutters within the group of cutters are located within one of the cone, the nose, the shoulder, or the gauge.

16. The drill bit of claim 10, wherein the side rake angle of each cutter on the bit is defined by the angular orientation of a cutting face of the cutter about an axis that is normal to a tangent to the cutting profile at the radial position of that cutter.

17. The drill bit of claim 10, wherein the first section and the second section of the offset blade are connected.

18. The drill bit of claim 10, wherein the first section and the second section of the offset blade are not connected.

19. The drill bit of claim 10, wherein the particular cutter and the different cutter are adjacent one another.

20. A downhole tool for removing rock to form a well bore, the tool comprising:

a bit body having a central axis about which the bit is intended to rotate, the body having a gauge and a cutting face;

a plurality of blades disposed on the cutting face and extending radially outwardly from the central axis that are separated from each other by a plurality of channels, each of the plurality of blades having a leading edge extending along one of the plurality of channels;

each of the plurality of blades having mounted along a leading edge of the blade a row of primary cutters for failing rock with a shearing action, each of the cutters having in fixed radial location within a cutting profile;

wherein, one of the plurality of blades is an offset blade comprising at least two portions, the two portions comprising an inner blade portion and an outer blade portion that is angular displaced with respect to the inner blade portion at an offset; and wherein the row of primary cutters on the offset blade comprises a first primary cutter and a second primary cutter that are adjacent to each other on the offset blade;

wherein the first and second primary cutters each has a non-zero side rake angle that differs from the other by at least 3 degrees; and wherein a polarity of the side rake angle of the first primary cutter differs from the polarity of the side rake angle of the second primary cutter.

* * * * *